US005724067A

United States Patent [19]

Atchley et al.

[11] Patent Number: 5,724,067

[45] Date of Patent: Mar. 3, 1998

[54] SYSTEM FOR PROCESSING INDIVIDUAL PIXELS TO PRODUCE PROPORTIONATELY SPACED CHARACTERS AND METHOD OF OPERATION

[75] Inventors: Hans B. Atchley, Greensboro; John J. Ronchetti, Sr., Kernersville, both of N.C.

[73] Assignee: Gilbarco, Inc., Greenboro, N.C.

[21] Appl. No.: 512,410

[22] Filed: Aug. 8, 1995

[51] Int. Cl.[6] ..... G09G 5/22

[52] U.S. Cl. ..... 345/141; 345/192; 345/194

[58] Field of Search ..... 345/141, 143, 345/144, 192–195, 197, 55, 114

[56] References Cited

U.S. PATENT DOCUMENTS

| | | | |
|---|---|---|---|
| 3,274,909 | 8/1963 | Hauerbach | 95/4.5 |
| 3,654,609 | 4/1972 | Bleuthman et al. | 395/117 |
| 3,712,443 | 1/1973 | Mathews | 400/304 |
| 3,729,714 | 4/1973 | Heard | 345/25 |
| 3,754,229 | 8/1973 | Manber | 340/324 |
| 4,000,486 | 12/1976 | Schomburg | 395/116 |
| 4,054,948 | 10/1977 | Grier et al. | 364/900 |
| 4,225,249 | 9/1980 | Kettler et al. | 400/3 |
| 4,225,943 | 9/1980 | Busch | 395/783 |
| 4,240,075 | 12/1980 | Bringol | 345/25 |
| 4,283,724 | 8/1981 | Edwards | 340/731 |
| 4,358,761 | 11/1982 | Iwasaki | 345/56 |
| 4,371,274 | 2/1983 | Jaeger | 400/121 |
| 4,426,645 | 1/1984 | Sakai et al. | 345/141 |
| 4,479,119 | 10/1984 | Sakano | 340/731 |
| 4,481,602 | 11/1984 | Bohrer et al. | 364/600 |
| 4,630,039 | 12/1986 | Shimada | 340/731 |
| 4,661,808 | 4/1987 | Rector et al. | 345/143 |
| 4,740,093 | 4/1988 | Malcolm | 395/108 |
| 4,864,518 | 9/1989 | Kurita | 345/141 |
| 4,907,282 | 3/1990 | Daly et al. | 382/242 |
| 4,974,174 | 11/1990 | Kleinman | 395/133 |
| 5,359,343 | 10/1994 | Nakamura | 345/100 |
| 5,563,626 | 10/1996 | Speed | 345/141 |
| 5,590,247 | 12/1996 | Mikuni | 395/110 |

*Primary Examiner*—Kee M. Tung

*Attorney, Agent, or Firm*—Antonelli, Terry, Stout, & Krauss, LLP

[57] ABSTRACT

A system (10) for proportionately spacing a plurality of characters is disclosed. The system includes a memory for storing a character font defining a group of characters which may be individually selected. Each selectable character contains at least one matrix of pixels with each matrix containing a plurality of rows of pixels with each row having pixels extending in a direction of reading of the pixels from the memory. Visible pixels in the at least one matrix of each selectable character define a visible shape which is stored in the memory as a first binary value. Background pixels in the at least one matrix of each selectable character, which are a remainder of a total number of pixels in the at least one matrix of each selectable character, are stored in the memory as a second binary value. A central processing unit (12) controls reading from the memory each of the rows of pixels from the at least one matrix of each of a plurality of characters in a sequence of pixel groups with each pixel group containing a fixed number of pixels. The central processing unit produce processed pixel groups containing the proportionately spaced plurality of characters by processing individual pixels within the sequence of pixel groups of the plurality of characters from the selected row. Each processed pixel group contains the fixed number of pixels including visible pixels from at least one character of the plurality of characters.

53 Claims, 6 Drawing Sheets

SYSTEM FOR PROCESSING INDIVIDUAL PIXELS TO PRODUCE PROPORTIONATELY SPACED CHARACTERS AND METHOD OF OPERATION

APPENDIX

Attached hereto is an Appendix containing 13 pages of computer code for execution on a Z180 microprocessor. The subject matter of the Appendix is copyrighted. A limited license is granted to anyone to reproduce or use the program modules contained in the Appendix for the purpose of understanding or analyzing the present invention. However, a license is not granted for the purpose of loading any data processing device with the subject matter of the Appendix without the express written consent of the Assignee. Pages 1–6 contain a module which processes information stored with a left justified font as illustrated in FIGS. 1 and 2 to permit storage in the memory space of the Z180 microprocessor. Pages 7 and 8 are a font header file containing necessary parameters after data formatting is performed by the program module at pages 1–6 for use in the Z180 microprocessor. Pages 9–13 are a control program for the Z180 microprocessor functioning as the central processing unit 12 of FIG. 4 as implemented in the circuit schematic of FIGS. 5A–D.

TECHNICAL FIELD

The present invention relates to a system and method for proportionately spacing characters which are generated from character fonts containing individual characters containing at least one matrix of pixels.

BACKGROUND ART

The Assignee of the present invention manufactures fuel dispensers which include optional display capability for generating video displays. The marketing of fuel dispensers requires that the purchasers be afforded several different options of fuel dispenser performance. A first option of fuel dispenser performance uses a microprocessor control which generates a display of the purchase price of the fuel being dispensed and the cumulative amount of the purchase in association with the control of the fuel dispensing function. A second option of fuel dispenser performance involves the integration of the first option microprocessor controlled fuel dispenser with a credit card reader in the dispenser. The credit card reader in the dispenser has a separate microprocessor control which manages the credit verification process including the generation of communications to a credit card clearinghouse and further, upon credit clearance, activates the operation of the fuel dispensing function which is controlled by the microprocessor of the fuel dispenser. A third option of fuel dispenser performance involves the integration of a display controller in association with the credit card reader in dispenser microprocessor control of the second option and the microprocessor controlled dispenser of the first option to provide a video display to facilitate the marketing of a wide range of products including fuel.

Marketing studies have shown that sales of products in association with the dispensing of fuel may be enhanced by the presentation to the customer of a video display during the pumping of fuel by the fuel dispenser. The ability to display on the video display a character generated message having proportionately spaced characters is highly desirable for the successful marketing of products by fuel dispensing stations. Proportionate spacing is the controlled spacing of background pixels between adjacent characters to produce an aesthetically pleasing character display.

As a consequence of the Assignee's optional fuel dispenser architecture having several microprocessor controls, it is extremely important that the overall expense of each microprocessor be minimized. Reducing the cost of the individual microprocessors required for each option lessens the cost of fuel dispensers which do not include the video display and/or the credit card reader in dispenser functions.

The microprocessors which are used by the Assignee in its fuel dispensers are an inexpensive industrial grade. However, these industrial grade microprocessors suffer from the disadvantage of having relatively low clock rates and therefor lower processing capability and further are byte oriented in their addressing space. As a result, the processing power in the microprocessor control of the assignee's video controller is not sufficient to provide software processing of pixel matrices in character fonts to provide proportionate spacing of messages generated from individual characters which are stored as one or more matrices of pixels. Software manipulation of stored matrices of pixels for generating proportionately spaced characters to generate each character of a proportionately spaced message is not feasible with the industrial grade microprocessor used by the Assignee in the generation of video displays in association with its higher performance higher cost fuel dispensing systems.

Character fonts are well known in the printing industry. A font is stored as a file containing an index to each character cell. Each character cell has at least one matrix of pixels which are bit mapped images within each character of the font. The index is generally a table that lists the coordinates, height of each matrix, width of each matrix, height of the character within each matrix, and width of each character within each matrix to permit retrieval for display. Additionally, other font parameters may be used but the foregoing parameters are the most commonly stored parameters.

Each character is comprised of at least one matrix with each matrix containing a plurality of rows of pixels. Each row has a fixed number of pixels which is typically a multiple of one or more bytes extending in a direction of reading of pixels from the memory. Visible pixels in the at least one matrix of each character define a visible shape of the character which is stored in a random access memory as a first binary value. Background pixels in the at least one matrix of each character are a remainder of a total number of pixels in the at least one matrix and are stored in the memory as a second binary value. Typically, the pixels of each matrix are read out in a series of bytes beginning in the top left-hand portion of the at least one matrix of the character from left to right and from the top row to the bottom row. Typically, the one or more matrices of each character are centered within the matrix. In general, each character has a width equal to an integer multiple of bytes of pixels containing therein a number of pixels required to contain the width of the character's bit mapped image and background pixels. Each matrix has a number of rows defining the character's height equal to the height of the bit mapped image plus room for ascender and descender pixels. It should be noted that the width of each character in pixels may or may not fall on a byte boundary of the at least one matrix of each character.

Commercially available display controllers for driving liquid crystal displays have an architecture which processes bytes of pixels which are inputted in parallel and sequentially read out for a serial display to define the character image to be generated. However, if alphanumeric messages are to be displayed using a font of characters, it is required that the controller, for the LCD, display byte quantities of pixels which are retrieved from the character font storing the at least one matrix of pixels which define each character. Therefore, what is required to provide data to the display controller for a liquid crystal display is that the character images are inputted in groups of eight pixels which are retrieved as a byte from a single address of the random access memory storing the character. The bytes of pixels are processed for display by the liquid crystal display controller a row at a time from left to right and from the top row to the bottom row. However, if characters are to be displayed which have pixels which do not fall on a byte boundary, what results are extra background pixels between adjacent characters if the character's pixels do not fill an entire byte of pixels. As a result, the display is not aesthetically pleasing to view because surplus background pixels are present at the right-hand boundary of the last of the at least one matrix which defines each character. It should be noted that the at least one matrix of the character font is stored across contiguous bytes of the address space of the random access memory storing the character font.

Display of individual characters which are fetched from the at least one matrix of pixels which defined each character, without additional processing to eliminate the surplus background pixels which appear at least to the right of each character, do not produce an aesthetically pleasing image and cause the text of the message to occupy extra space. The result is surplus background space and variable intercharacter spacing.

Manufacturers of controllers for liquid crystal displays provide a small resident font of characters comprised of at least one matrix of pixels for each character which produce the aforementioned adjacent channels spacing having surplus background pixels between the adjacent characters. This type of character font is small in size and is difficult to see which makes it unacceptable for applications such as the display of character generated images on display devices associated with fuel dispensers of the Assignee for purposes of providing useful information to facilitate the fueling process or marketing of additional products or services by the dispensing station. Furthermore, the commercially available controllers for liquid crystal displays are limited to displays in two languages, which are English and Japanese, and therefore, do not facilitate marketing of the Assignee's dispensers in its existing non-English-Japanese speaking markets.

The use of shift registers in a controller for a liquid crystal display or raster-type display is well known. Examples of the use of shift registers in these types of systems are disclosed in U.S. Pat. Nos. 5,359,343 (Nakamura), 4,479,119 (Sakano), 4,630,039 (Shimada), 4,371,274 (Jaeger), 4,283,724 (Edwards), 4,225,249 (Kettler et al), 4,054,948 (Grier et al), 3,754,229 (Manber) and 3,274,909 (Hauerbach). Edwards, Shimada, Sakano, Manber and Grier et al disclose the display of variable size characters and/or proportional spacing of characters in combination with the use of shift registers. Furthermore, Nakamura, Jaeger and Hauerbach disclose proportionate spacing with the use of shift registers. However, none of these patents pertains to the use of shift registers to interface to a display controller such as an LCD display controller which contains the well-known parallel to serial display converter for displaying pixels on a display to generate a proportionately spaced character image.

DISCLOSURE OF INVENTION

The present invention is a system and method for proportionately spacing characters which are stored in a character font. Each character is stored as at least one matrix containing a plurality of rows of pixels with each row having pixels extending in a direction of reading of the pixels from the character font. As used herein, a character is a matrix of pixels containing only visible pixels, groups of visible and background pixels which are used to form the typical characters used in alphanumeric messages and a matrix of pixels which contains only background pixels. Furthermore, a spacing code is a pixel group of background pixels which is used for purposes of inserting background pixels between visible pixels of adjacent characters where a number of background pixels are required to provide proportionate spacing between the adjacent characters extending past the outside boundary of the last matrix of the first character in a direction of reading of pixels from the character font. With the invention, pixel groups, which preferably are an integer multiple of bytes of pixels, are read out in parallel under the control of a microprocessor and stored in a first hardware storage element such as a shift register. The microprocessor stores the width of each character to be proportionally displayed as a number of visible pixels in each row. The pixel groups which are stored in the first shift register are serially read out from the first shift register into a second shift register under the control of a first counter which is loaded with a number provided by the microprocessor which represents the number of pixels to be shifted out of the first shift register into the second shift register which define the outside boundary of visible pixels of one character plus any background pixels used for proportionate spacing between adjacent characters within the pixel group. The number is typically not the width of the pixel group in the direction of reading and represents the number of visible pixels within the pixel group plus any desired background pixels used for proportionate spacing including between any adjacent characters therein to be proportionally spaced. When the visible pixels on an outside edge of a character are located inside of an outside edge of the pixel group by a number of background pixels less than the number of background pixels required for the desired proportionate spacing or the outside edge of the character is located on the outside edge of the pixel group, any background pixels required for spacing between adjacent characters are provided from a spacing code which is loaded in the first shift register and shifted out under control of the number loaded from the microprocessor with the number being the number of background pixels required from the spacing code to obtain the desired proportionate spacing between the adjacent characters. In a preferred application of the present invention, the proportionate spacing is constant, i.e. a fixed number of background pixels, such as two, but the present invention is not limited thereto with the number of proportionate pixels being variable. The first counter is decremented after each pixel is shifted out from the first shift register to the second shift register with the pixels being read out from the left-hand edge of the pixel group into the second shift register. When the first counter reaches zero, the shifting of the pixel group stored in the first shift register is completed with any remaining pixels therein being discarded. Thereafter, another pixel group is provided under control of the microprocessor to the first shift register along with the loading of the desired number of pixels to be shifted out in order to accomplish proportionate spacing. A second counter stores the number of pixels which have been shifted into the second shift register from the first shift register. When the second counter reaches a fixed number representative of a number of pixels to be outputted to the display controller, which is typically an integer multiple of bytes, the second counter signals the display controller which activates read out in parallel of the pixels from the second shift register to the display controller where the pixel group is processed and subsequently serially read out under the control of the display controller to a display device which, in a preferred application of the present invention, is a liquid crystal display which is based upon a byte addressable architecture as is widely used with commercial liquid crystal displays.

Effectively, the invention provides the parallel read out of pixel data defining characters to be displayed from a character font stored in a random access memory of the address space of the microprocessor under the control of the microprocessor to a parallel to serial to parallel converter which addresses and processes individual pixels from the at least one matrix of pixels defining each character, and the spacing code, to produce proportionate spacing between adjacent characters. The processing includes discarding of individual background pixels or adding background pixels from the spacing code when a last pixel group of a character contains insufficient background pixels necessary for providing the desired proportionate spacing between an adjacent character. Processing of the at least one matrix of each character is performed by sequentially reading out the at least one pixel group which spans the width of each character such that the rows are read out from top to bottom of each character. Any surplus background pixels which are present in any of the at least one matrix of each of the characters in a row are discarded when a last pixel group of a character contains more background pixels in a direction of reading the pixels between an outer edge of the character and an outer edge of the pixel group than are required for proportionate spacing between the character and the adjacent character.

While the invention is not limited thereto, in a preferred application of the invention, the at least one matrix of pixels which comprises each character is left justified. Commercially available software exists for modifying commercially available character fonts of characters each comprised of at least one matrix of pixels for converting the justification of the characters therein, which are typically center justified, to a left justified format which provides the visible pixels of each matrix of the at least one matrix of each character to always begin on a left-hand margin. The method of left justification of characters of a character font is not part of the invention. As a result, the outputting of the left-hand pixels from the first shift register to the second shift register does not require discarding of background pixels between adjacent pixel groups of adjacent characters. However, as stated above, the left justification of the at least one matrix of the plurality of characters which are proportionally spaced by the present invention is not required to practice the invention. It should be understood that background pixels required for proportionate spacing between adjacent characters may also be obtained in part from background pixels on the left-hand or right-hand margin of the at least one matrix of each character if the characters are not left hand justified but additional individual pixel processing will be required to remove the background pixels within each matrix which are not usable for proportionate spacing.

The present invention provides for hardware processing of pixels stored in the at least one matrix of pixels of each character of a character font which facilitates the use of relatively low clock rate, inexpensive industrial grade microprocessors which are utilized in applications, such as fuel dispensers, such as those marketed by the Assignee. With the invention, the hardware processing of pixels of the at least one matrix defining each character individually addresses and processes the pixels within the pixel groups which are read from the character font that facilitates proportionate spacing. The invention is unlike commercially available display controllers, such as liquid crystal displays, in which a byte or multiples of bytes of pixels are addressed during the generation of a display which interferes with providing proportionate spacing between adjacent characters. The ability to address and process individual pixels of the at least one matrix of pixels of each character permits proportionate spacing to be accomplished without adding an unacceptably high processing overhead to the microprocessor for controlling the display of alphanumeric or graphics information along with the performance of the other tasks already assigned to the microprocessor of the video display of the fuel dispensers of the Assignee.

A process for proportionally spacing a plurality of characters in accordance with the invention includes storing a character font in a memory defining a group of characters which may be individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of a total number of pixels in the at least one matrix of each selectable character are stored in the memory as a second binary value; reading from the memory a selected row of pixels from the at least one matrix of each of the plurality of characters in a sequence of pixel groups with each pixel group containing a fixed number of pixels; producing processed pixel groups containing the proportionately spaced plurality of characters by processing individual pixels within the sequence of pixel groups of the plurality of characters from the selected row and sequentially outputting in parallel the processed pixel groups of the selected row; and repeating the above reading, producing and outputting steps to select and process each remaining row of the matrices of the plurality of characters. The processing of the individual pixels includes serial processing of pixels of the selected row which are sequentially outputted in the processed pixel groups; and the processed pixel groups of the selected row are outputted in parallel to a display controller and displayed by a display device under control of the display controller. The at least one of the processed pixel groups contains pixels from two characters of the plurality of characters separated by the number of background pixels required for the proportionate spacing between the characters. The processed pixel groups are produced by discarding surplus pixels from the selected row of the matrices of the plurality of characters or a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters in which event proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters. One matrix of each of the characters has visible pixels extending from a vertical outer edge of the matrix in the direction of reading. In a preferred application, the vertical outer edge is the left-hand edge of the one matrix and the proportionate spacing between each pair of the plurality of characters is a set number of pixels which may be two. In a preferred application of the invention, the display device is a liquid crystal display but the invention is not limited thereto.

A system for proportionately spacing a plurality of characters in accordance with the invention includes a memory for storing a character font defining a group of characters which may be individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of the total number of pixels in the at least one matrix of each selectable character are stored in the memory as a second binary value; means for reading from the memory each of the rows of pixels from the at least one matrix of each of the plurality of characters in a sequence of pixel groups with each pixel group containing a fixed number of pixels; and means for producing processed pixel groups containing the proportionately spaced plurality of characters by processing individual pixels within the sequence of pixel groups of the plurality of characters of each of the rows of pixels. The means, for processing the individual pixels serially, processes pixels of a selected row which are sequentially outputted in parallel in the processed pixel groups and the processed pixel groups of the selected row are outputted to a display controller and displayed by a display device under control of the display controller. The at least one of the processed pixel groups contains pixels from two characters of the plurality of characters separated by a number of background pixels representing the proportionate spacing between the characters. The processed pixel groups are produced by discarding surplus pixels from the selected row of the matrices of the plurality of characters or a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters in which event proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters. One matrix of each of the characters has visible pixels extending from a vertical outer edge of the matrix in the direction of reading with the vertical outer edge preferably being the left-hand edge of the one matrix and the proportionate spacing between each pair of the plurality of characters is a set number of pixels determined by software selection.

The means for reading comprises a microprocessor; and the means for producing comprises the first and second shift registers, a first counter, second counter, and the microprocessor. The first shift register is coupled to the microprocessor for receiving in parallel the pixel groups. The second shift register is serially coupled to an output of the first shift register for serially receiving individual pixels outputted from the first shift register. The first counter is coupled to the microprocessor and to the first shift register for storing a number received from the microprocessor representing a number of visible pixels and any background pixels required for proportionate spacing between any adjacent characters in the pixel group to be serially shifted out of the first shift register from each pixel group received from the microprocessor, counts the number of pixels which are shifted serially from the first shift register into the second shift register and inhibits further shifting of pixels from the first shift register into the second shift register when a number of pixels have been shifted from the first shift register to the second shift register which equals the number stored in the first counter, the second counter counts the number of pixels which have been received by the second shift register from the first shift register and providing an output when the number of pixels received by the second shift register equals the fixed number and the second shift register in response to the second counter counting the fixed number of pixels outputting in parallel the fixed number of pixels stored in the second shift register. The first shift register receives another pixel group of pixels from the microprocessor after the number of pixels equal to the number stored in the first counter has been shifted to the second shift register and the first counter receives and stores from the microprocessor another number of pixels of the another pixel group to be shifted from the first shift register to the second shift register. The additional number is a number of visible pixels and any background pixels required for proportionate spacing between visible pixels between adjacent characters in the pixel group; and the additional number of pixels from the additional pixel group are serially shifted from the first shift register to the second shift register and thereafter the first counter inhibits the serial shifting of any additional pixels from the another pixel group in the first shift register to the second shift register.

BRIEF DESCRIPTION OF DRAWINGS

Like reference numerals identify like parts throughout the drawing.

BEST MODE FOR CARRYING OUT THE INVENTION

Figure 1:
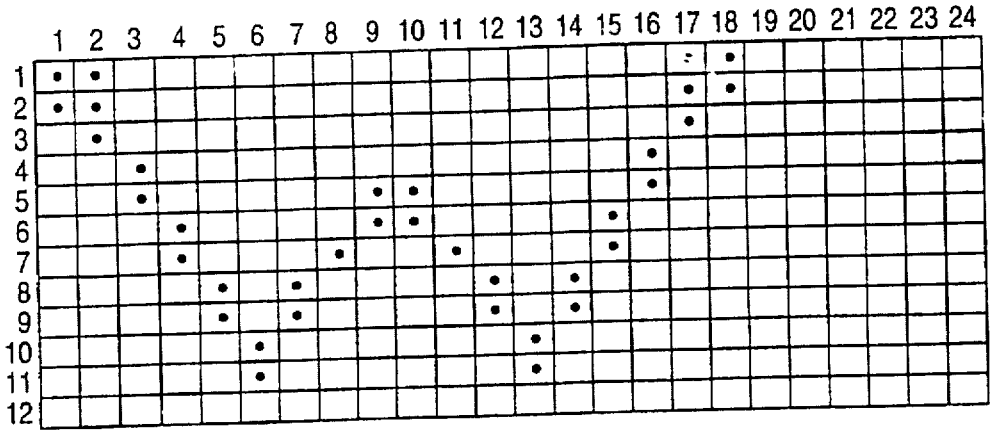
FIG. 1 illustrates a left-hand justified "W" stored as three matrices of pixels each having eight pixels for use with the practice of a preferred embodiment of the present invention which uses left-hand justified characters.
Figure 2:
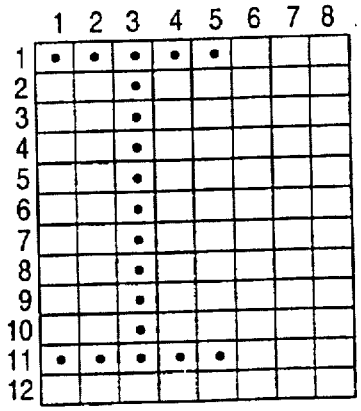
FIG. 2 illustrates an "T" which is stored as a single matrix of pixels eight pixels wide which is used with a preferred embodiment of the present invention having left-hand justified characters.
Figure 3:
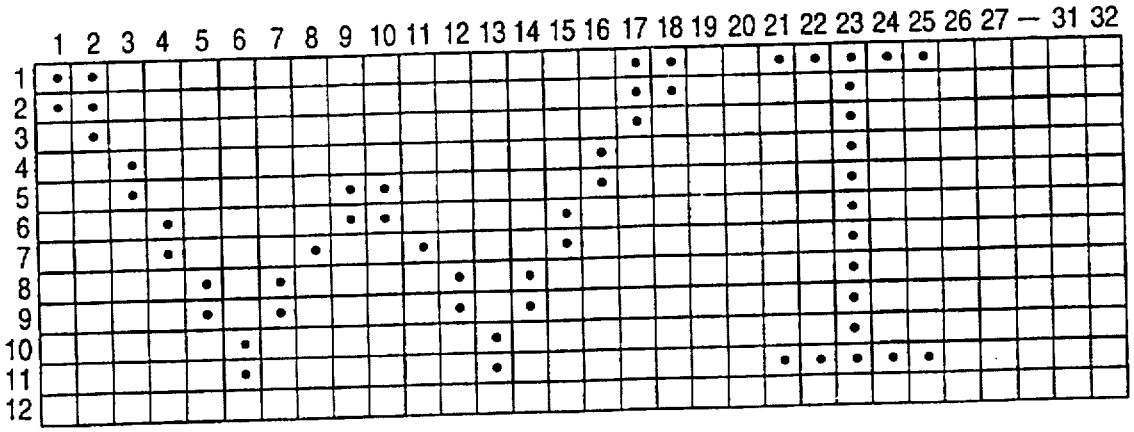
FIG. 3 illustrates graphical display of the letters "W" and "T" of FIGS. 1 and 2 which are proportionately spaced in accordance with the present invention.

FIGS. 1–3 illustrate the process of the present invention for proportionately spacing the letters "W" and "T", which are respectively stored in three matrices and one matrix of pixels. The characters "W" and "T" are retrieved from a font of characters. Characters used for the practice of the invention are comprised of at least one matrix of pixels which pixels may be visible and/or background pixels. Each matrix may contain all visible pixels which are stored as a single binary value, visible and background pixels which are respectively stored as different binary values and all background pixels which are stored as a single binary value opposite the binary value which is stored for the visible pixels. Each matrix of the characters in this example has a width of a fixed number of pixels and is one byte of pixels wide in the direction of reading of the pixels from a random access memory associated with a processor for implementing the present invention.

FIGS. 1 and 2 illustrate the letters "W" and "T" which are contained in the preferred character format of the visible pixels that is left justified to facilitate the read out from a first shift register of the highest order pixels without any background pixels preceding the highest order pixels as they are shifted into the second shift register as described below in conjunction with FIGS. 4 and 5A–5D where the pixels are grouped after discarding of any surplus background pixels in the at least one matrix of each character which are not required for proportionate spacing into a pixel group also eight pixels wide or after adding any background pixels from a spacing code to provide sufficient background pixels for proportionate spacing and are outputted to the display controller as described below for processing for display by a display device. As is illustrated in FIG. 3, the proportionate spacing between the letters "W" and "T" is two background pixels wide in pixel positions 19 and 20 which is a preferred form of proportionate spacing between all adjacent pairs of characters in accordance with the present invention. However, it should be understood that the invention is not limited to a fixed proportionate spacing between adjacent characters with it also being possible for the processor to specify different proportionate spacings of background pixels between particular pairs of adjacent characters based upon aesthetic considerations. As is illustrated in FIGS. 1 and 2, the characters "W" and "T" are part of a character font stored in the random access memory of the microprocessor containing additional alphanumeric characters and other graphical symbols as described above which may be individually selected for generation of a character display with proportionate spacing between each pair of adjacent characters.

Each selectable character contains at least one matrix of pixels which, as illustrated in FIGS. 1 and 2, is eight pixels wide in the direction of reading of the pixels from the memory. Each character is twelve pixel rows high which requires the twelve rows of pixels to be sequentially read out beginning with row number 1 through row number 12 during processing of the pixels of each character to generate the proportionate display of a plurality of characters. A typical proportionately spaced textual message contains a large number of characters defining a plurality of words per line of text. As illustrated, the letter "W" in FIG. 1 has a maximum width of 18 visible pixels at its outermost edges which spans 2-¼ bytes of pixels which are read out in successive read out cycles under the control of the processor as described below. The letter "T" in FIG. 2 is stored in a single matrix of pixels with a maximum width of five visible pixels at its outermost edges and three background pixels. The visible pixels, as illustrated in each of the at least one matrix of each selectable character, such as the letters "W" and "T", define the visible shape of the character which is stored in the random access memory of the processor as a first binary value.

In accordance with the invention, each of the successive pixel groups from the matrices of the letters "W" and "T", which are one byte wide, are successively read out beginning from the top row 1 across each of the characters "W" and "T" to the bottom row 12 of each of the characters beginning with the pixel groups on the left extending to the right of the letter "W" and then to the pixel group of the letter "T" after processing as described below by the system of FIGS. 4 and 5A–5D to produce the proportionately spaced letters "W" and "T" in FIG. 3 having a proportionate spacing between the characters of two background pixels. The read out of each pixel group of the letters "W" and "T" in parallel in pixel groups of eight pixels follows the sequence beginning in row 1 with reading out pixels 1–8 followed by reading out pixels 9–16 followed by reading out pixels 17–24 to complete the read out of the first row of the letter "W" followed by the read out of pixels 1–8 of the letter "T" of FIG. 2. Each of the rows 2–12 is successively read out in this fashion under the control of the system processor preferably with a byte of pixels in each pixel group being read out during each read out cycle.

While the example in FIGS. 1–3 illustrates the proportionate spacing of only the two letters "W" and "T", it should be understood that the invention is practiced in the same fashion for groups of characters to compose a desired proportionately spaced character message in accordance with the invention.

Commercially available software tools may be used to convert a character font in which the characters are stored as a bit mapped image of visible pixels which is centered within the width of the character cell which is an integer number of bytes of pixels wide into a left justified font. Thus, with respect to the letters "W" and "T" of FIGS. 1 and 2 obtained from a commercially available software implemented character font, the character "W" would initially be centered across its width with three background pixels in the outer most left and right-hand columns 1–3 and 22–24 respectively and the character "T" would initially be centered with either one or two background pixels in the left-hand columns 1 or 2 and the remaining background pixels in at least column 8 to make up the total of three background pixels which are on the outer most edges. The commercially available software converts the centered characters into the left justified characters "W" and "T" of FIGS. 1 and 2.

In a preferred application of the present invention which utilizes a Z180 microprocessor, as illustrated in FIGS. 4 and 5A–D, it is desirable to eliminate unnecessary overhead from a left justified character font as illustrated in FIGS. 1 and 2 to optimize proportionate spacing without interfering with other functions which are also being performed in association with the dispensing of fuel. A suitable program for eliminating the unnecessary information stored with a left justified font to provide for storage in the limited memory space associated with the Z180microprocessor is contained in the program module of the Appendix at frames 1–6. Frames 7 and 8 are a font header file containing the necessary parameters for the data reformatting performed by the program module at frames 1–6 for use on the Z180microprocessor. After the data reformatting is performed in accordance with the program modules at frames 1–8, the required information does not interfere with execution of the present invention on the Z180microprocessor in association with other tasks which it performs in conjunction with the Assignee's commercial fuel dispensing systems.

Figure 4:
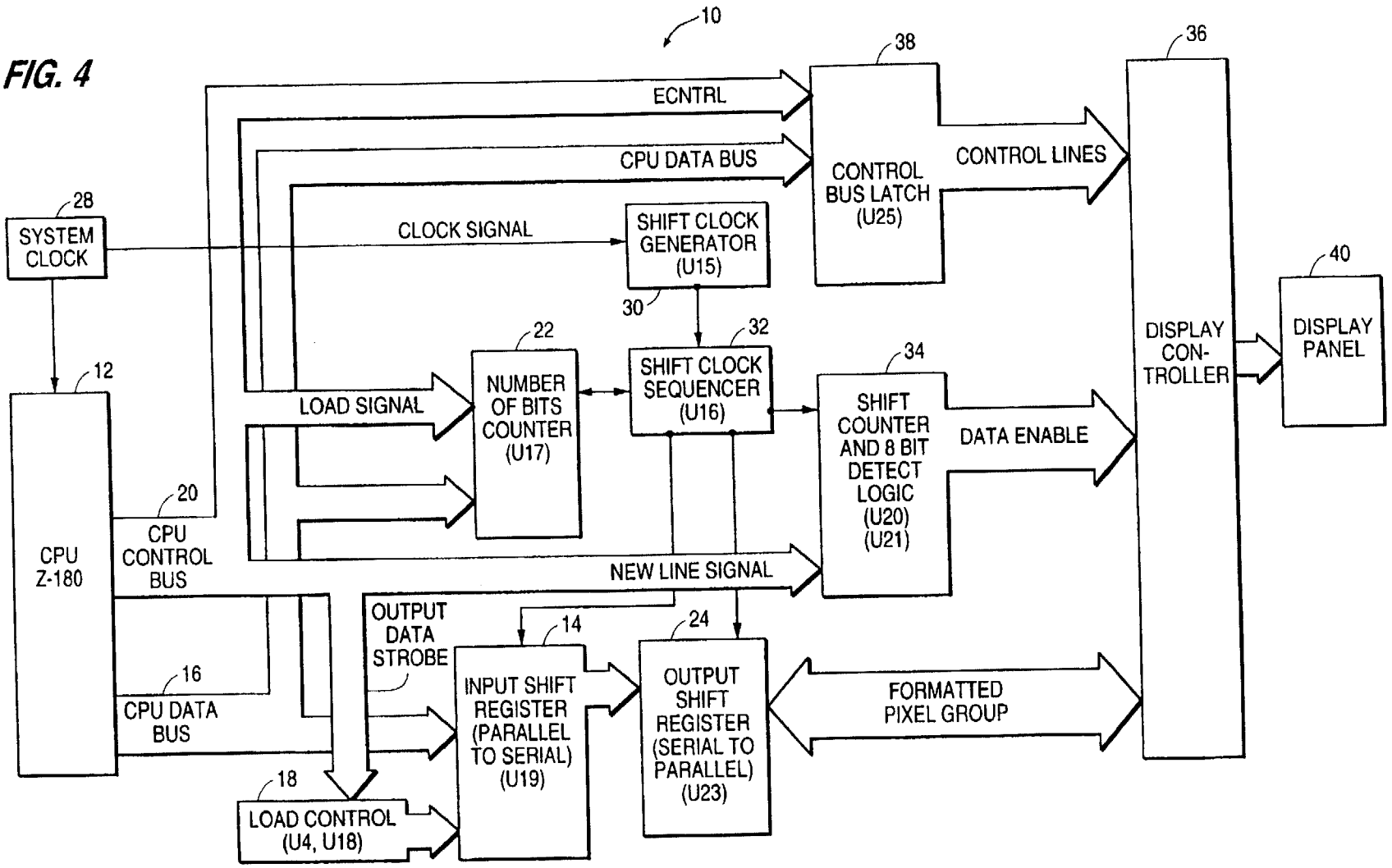
FIG. 4 illustrates a block diagram of a system for producing proportionate spacing of a plurality of characters in accordance with the present invention.

FIG. 4 illustrates a block diagram of a system 10 in accordance with the invention for proportionally spacing a plurality of characters such as, but not limited to, those discussed above in conjunction with FIGS. 1–3. FIGS. 5A–5D illustrate a circuit schematic for implementing the functions of the block diagram of FIG. 4. Integrated circuits and other components for implementing the block diagram of FIG. 4 are identified in the circuit schematic of FIGS. 5A–5D with their commercial designation or part number. A number in parenthesis in the blocks of FIG. 4 identifies an integrated circuit(s) in FIGS. 5A–5D for implementing the function of the block containing the parenthetically enclosed number.

The system 10 of FIGS. 4 and 5A–5D is described as follows. The system central processing unit 12 controls the system 10 in accordance with the program listing contained at frames 9–13 of the Appendix. Input shift register 14 receives the left justified font characters, such as those illustrated in FIGS. 1 and 2, over the central processing unit data bus 16 from the random access memory (not illustrated) associated with the CPU 12. The CPU 12 reads from its associated random access memory the series of rows of selected pixels as described above in FIGS. 1–3 from the at least one matrix of each of the plurality of selected characters of each row of characters to be displayed in a sequence of pixel groups from each of the selected characters of each row of characters to be displayed in the order in which they are displayed from left to right. Each pixel group, which is one byte of pixels wide, is read out in parallel and transmitted over the central processing unit data bus 16 to the input shift register 14. The input shift register 14 functions as part of a parallel to serial to parallel converter as described below providing addressability and processing of individual pixels within the pixel groups which are read from the at least one matrix of each character. The load control 18 is a decoding circuit which is activated by the system central processing unit control bus 20 which functions to cause the left justified sequence of pixel groups during reading out of each row of the plurality of rows of the plurality of characters to be proportionately spaced in a row to be sequentially loaded into the input shift register 14 as pixel groups. The number of bits counter 22 stores the number of visible pixels and background pixels which are to be shifted from each pixel group stored in the input shift register 14 to the output shift register 24 to achieve desired proportionate spacing between the visible pixels of adjacent characters (e.g. two background pixels in FIG. 3). The number of bits counter 22 is loaded when the CPU 12 activates the central processing unit control bus 20 with the LOAD SIGNAL. The system clock 28 provides a CLOCK SIGNAL to the CPU 12 and to the shift clock generator 30 which divides the CLOCK SIGNAL in two and applies it to the shift clock sequencer 32. The shift clock sequencer 32 provides overall timing for the circuitry associated with the input shift register 14 and output shift register 24 for performing parallel to serial to parallel pixel processing to obtain proportionate spacing between adjacent characters as described above. The shift clock sequencer 32 supplies output signals that activate the serial shifting of pixels from the input shift register to the output shift register 24, decrements the number of bits counter 22 and loads the shift counter and 8 bit detect logic 34. The output shift register 24 functions to collect pixel groups containing serially processed pixels which are shifted out of the input shift register 14 under the control of the number of bits counter 22 so that surplus background pixels are discarded to leave only necessary visible pixels plus any necessary background pixels or pixels are added from a spacing code for providing proportionate spacing between visible pixels of adjacent characters which are being proportionately spaced in each pixel group of eight pixels as described below. The output shift register 24 outputs in parallel pixel groups under the control of a shift counter and 8 bit detect logic 34. The shift counter and 8 bit detect logic 34 functions to detect when a complete byte of formatted serially processed pixel group is collected in the output shift register 24. The output shift register 24, as will be described below, outputs formatted bytes of pixels to the display controller 36 after the shift counter and 8 bit detect logic 34 has produced a DATA ENABLE signal which is applied to the controller. The control bus latch 38 provides a control port to the display controller 36. The control signals for the display controller 36, which are produced by the CPU 12, are transmitted through the control bus latch 38.

The operation of the system of FIG. 4 is described as follows. The signal ECNTRL, which is outputted on the central processing unit control bus 20 under the control of the CPU 12, is used to write necessary control information directly into the display controller 36 through the control bus latch 38. The necessary control information includes a reset signal to the display controller 36, display select information signal commands and data select signals, etc., which are produced under the control program contained in frames 9–13 of the Appendix. The central processing unit control bus 20 outputs a NEW LINE SIGNAL which initializes the system 10. After the activation of the NEW LINE SIGNAL under the control of the CPU 12, the shift counter and 8 bit detect logic 34 is loaded with a value of eight which represents the number of bits in the pixel groups which are being processed. The output shift register 24 is cleared. Thereafter, a sequence of pixel groups containing eight pixels, such as that described above and below, is sequentially placed on the central processing unit data bus 16 under the control of the CPU 12 which groups are preferably in the left justified format of FIGS. 1 and 2. The central processing unit control bus 20 outputs the OUTPUT DATA STROBE signal which is applied to the load control 18 that causes the pixel group on the central processing unit data bus 16 to be latched in parallel into the input shift register 14. The number of bits to be shifted out of the input shift register 14 into the output shift register 24 for each pixel group of each character (from one to eight when the pixel groups contain eight pixels) is loaded into the number of bits counter 22 by activation of the LOAD SIGNAL. The LOAD SIGNAL is _NUM BITS in FIG. 5A and causes that number of bits to be shifted out of the input shift register 14 for each pixel group to produce the desired proportionate spacing to be latched into the number of bits counter 22. At this time, the loading of the number of bits counter 22 activates the shift clock sequencer 32 which outputs repetitively a sequence of ten pulses from U16 in FIG. 5A. Three significant pulses are illustrated in FIG. 4. These three significant pulses are identified as CLK 1, 2 and 3 in FIG. 5A.

As a consequence of the characters being stored in at least one matrix which are left justified as illustrated in FIGS. 1 and 2, the first pixels to be shifted into the output shift register 24 stored in the input shift register 14 are the high order pixels of the pixel group which permits those bits to be directly outputted to the output shift register without further processing. The highest order bit is Q7 of U19 of FIG. 5A. As the clock pulse CLK 1 occurs in FIG. 5A, the highest order pixel is clocked from the input shift register 14 to the output shift register 24. As the next clock pulse occurs CLK 2 of FIG. 5A, the next bit of the left justified pixels of the pixel group are shifted into the Q7 position in integrated circuit U19 of FIG. 5A. At this time, the shift counter and 8 bit detect logic 34 is decremented by one. At the time of the clock pulse CLK 3 of FIG. 5A, the number of bits counter 22 is decremented and a reload of the shift counter and 8 bit detect logic 34 is attempted. Finally, at the next clock pulse cycle, the shift clock sequencer 32 is reset and the cycle starts over again. These cycles repeat until the number of bits counter 22 is decremented to zero. At this time, the shift clock sequencer 32 is inhibited until another input of a pixel group from the random access memory of the CPU 12 to shift register 14 and loading of the number of bits counter 22 is performed. It is important to note that while the shift clock sequencer 32 is running, the shift counter and 8 bit detect logic 34 is decremented for each complete cycle of the shift clock sequencer 32. As a result, the shift counter and 8 bit detect logic 32 is decremented for each bit shifted into the output shift register 24 from the input shift register 14. When the shift counter and 8 bit detect logic 34 reaches zero, a complete processed pixel group, which is comprised of pixels which have been individually serially processed to discard any surplus background pixels not required for proportionate spacing between any visible pixels of adjacent characters in the pixel groups, is assembled in the output shift register 24 which may then be inputted to the display controller 36.

If the last matrix of the at least one matrix of pixels of a character in a row has a number of background pixels extending from an outermost visible edge of the character to the edge of the matrix in the direction of reading which is less than a number of background pixels required for proportionate spacing or the outermost visible edge of the character falls on the edge of the matrix in the direction of reading, a spacing code is used to add a number of background pixels to provide sufficient background pixels to obtain the desired proportionate spacing. A pixel group in the row which is being processed to provide proportionate spacing between characters is loaded into the first shift register 14. The bit counter 22 is loaded with the number to cause the required number of background pixels to be shifted from the first shift register 14 to the second shift register 24 to add the requisite number of background pixels from the spacing code to obtain proportionate spacing. The number which is loaded in the counter 22 to provide background pixels from the row of the matrix of the spacing code is equal to the number of background pixels required for proportionate spacing less the number of pixels between the outside edge of the last matrix of the character in the row and the edge of the matrix in the direction of reading.

The display controller of FIGS. 5A–5D is designed to produce parallel outputted pixel groups which, in a preferred embodiment, are bytes of pixels for display and sends them to a conventional display device, such as a LCD display panel or a raster-type display to produce a proportionately spaced group of characters such as the letters "W" and "T" illustrated in FIG. 3. The shift counter and 8 bit detect logic 34 sends the DATA ENABLE signal to the display controller 36 which remains active until the clock pulse CLK 3 occurs. When the clock pulse CLK 3 occurs, the DATA ENABLE signal is deactivated and the shift counter and 8 bit detect logic 34 is reloaded with the number of pixels in the pixel group which is eight in the example as given. The display controller 36 detects the DATA ENABLE signal and processes the contents of the output shift register 24 in the conventional fashion to produce conversion from a parallel format to a serial format for outputting of individual pixels for display by the display panel 40. When the number of bits counter 22 is being decremented, the CPU 12 receives a WAIT signal which suspends the CPU operation until the WAIT signal goes false. The integrated circuit U18-A of FIG. 5B produces the WAIT signal.

Figure 5A:
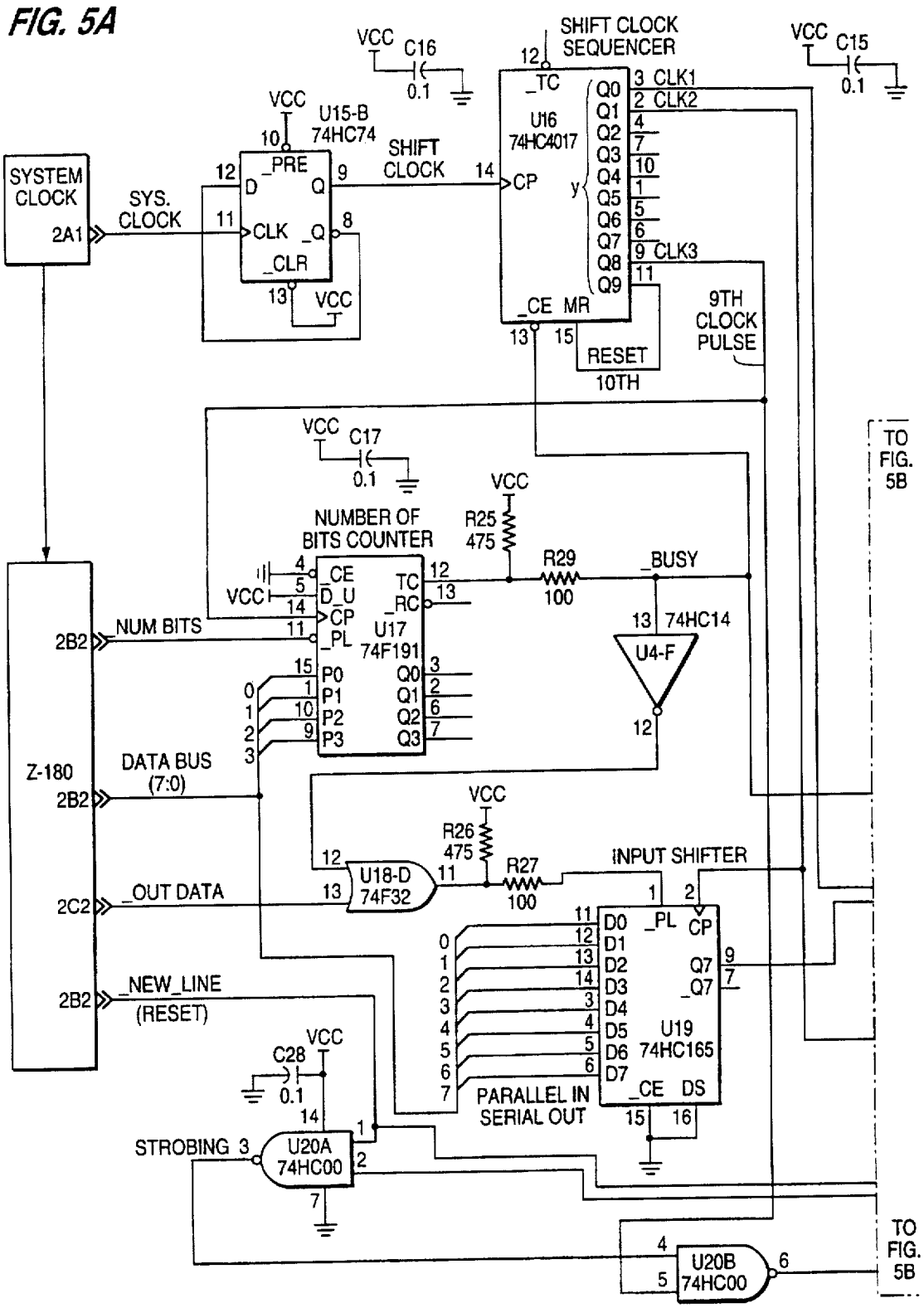
FIGS. 5A–D represent a circuit schematic of a preferred embodiment for implementing the block diagram of FIG. 4 for practice of the present invention.
Figure 5B:
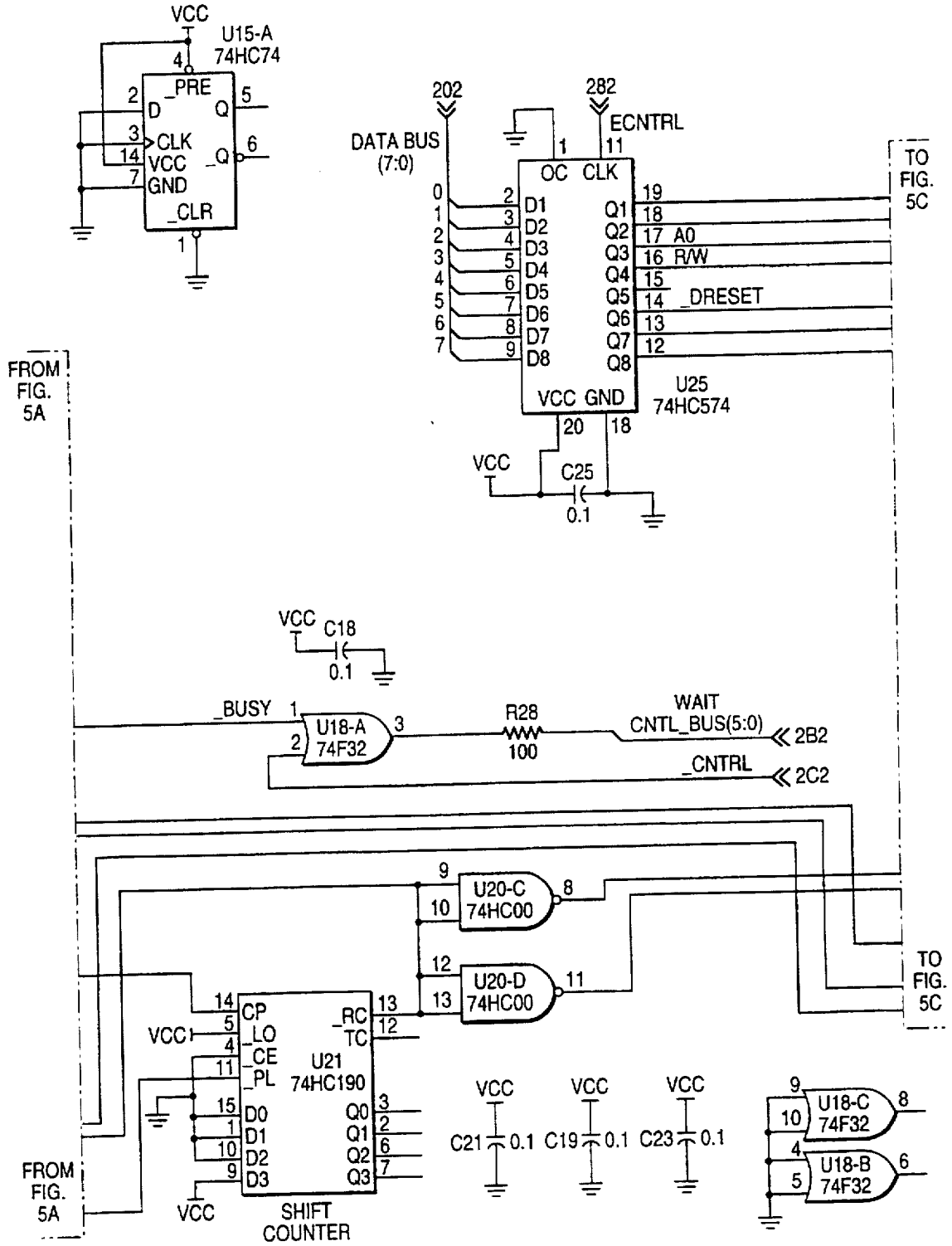
Figure 5C:
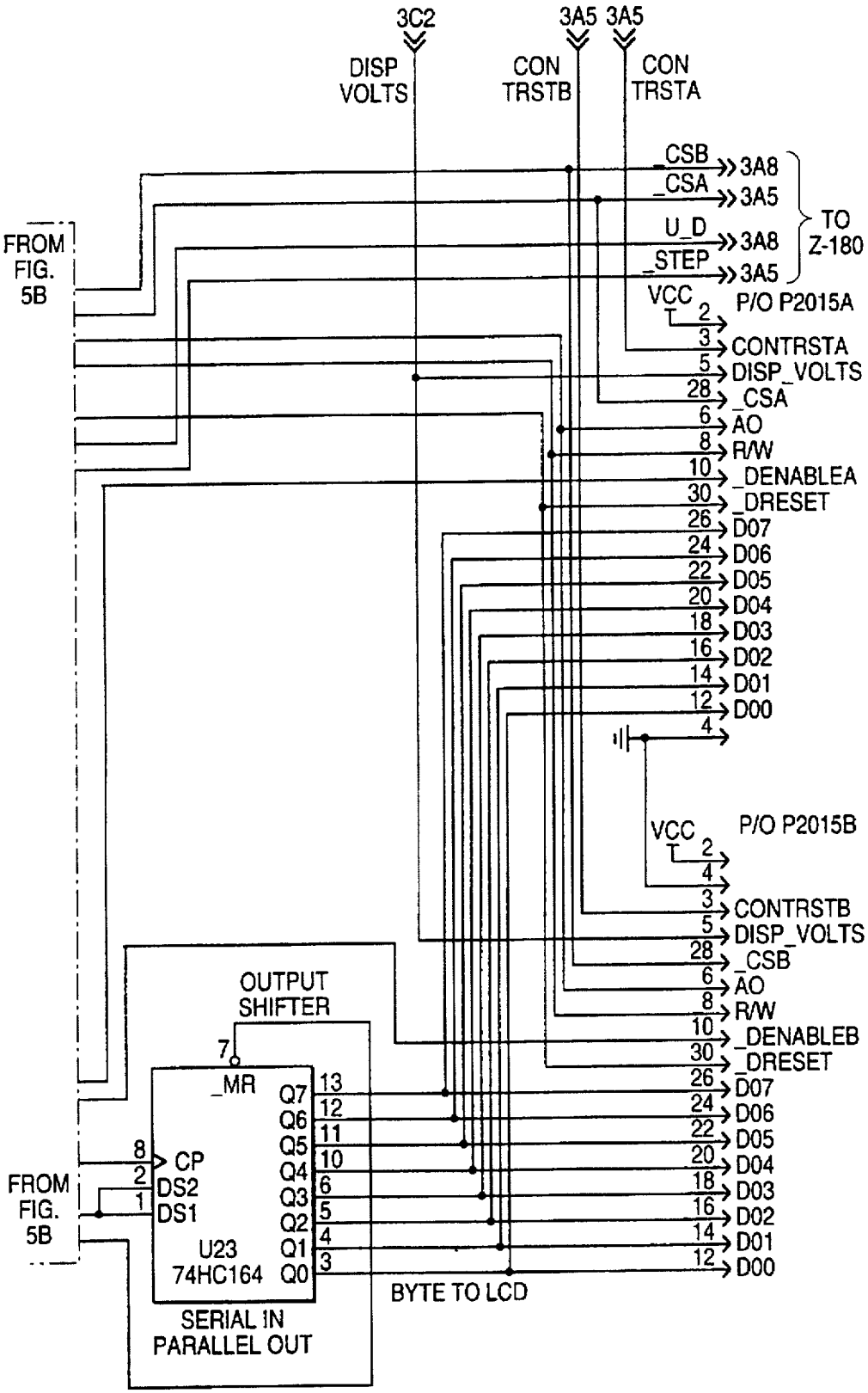
Figure 5D:
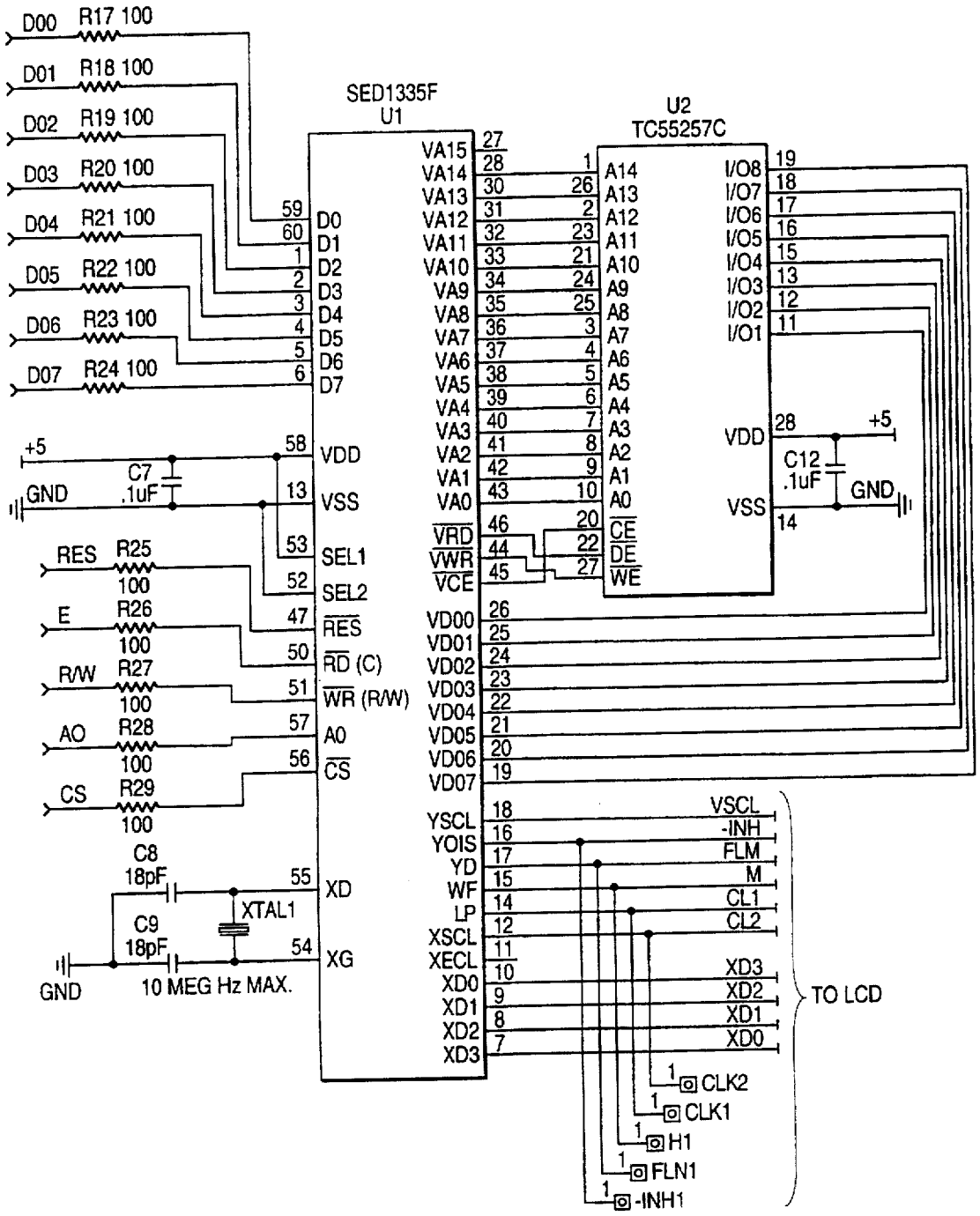

The mnemonics of the signals in the circuit schematic of FIGS. 5A–D are those generally used in the industry or by the manufacturers of the identified integrated circuits. Therefore, an explanation of each of the mnemonics will not be given as it is not necessary for understanding or practicing the invention. However, the inputs to some of the integrated circuits of FIGS. 5C and 5D are explained as follows. The signal RES performs a hardware reset and is connected to an output of an address decoder that maps the integrated circuit U1 into the memory space of the CPU 12. The signal CS is a chip select signal which enables U1 and is connected to the output of the address decoder that maps U1 into the address space of the CPU 12. The signal R/W is a read/write control signal that determines when a read from or a write to integrated circuit U1 is performed. R/W must be low to write while E is high. R/W must be high to read while E is low. The signal E enables output buffers of U1. The signal AO is used to perform data type selection in the display controller integrated circuit U1 and controls the type of accesses done to the integrated circuit U1. The signals D00–D07 are the data inputs to the integrated circuit U1. The signals CONTRSTA and CONTRSTB are analog signals for adjusting contrast on the liquid crystal display panel which is the display of the preferred embodiment. The signals DENABLEA and DENABLEB are the (E) signals for each display controller. The signals CSA and CSB are chip select signals for side A and side B liquid crystal controller integrated circuits. The signal DISP VOLTS is the liquid crystal display voltage which may be selected to be −25 volts or +35 volts. The signal VCC is 5 volts which is provided to the display panel of the liquid crystal display.

The overall functioning of the block diagram of FIG. 4 is described as follows with reference to FIGS. 1–3. In the example explained above in FIGS. 1–3, it is desired to proportionately space the letters "W" and "T" by a proportionate spacing of two background pixels. This simplified example is duplicated in actual practice of the invention with a much larger number of selected characters of each row of characters which form a desired alphanumeric message. As is illustrated in FIG. 1, the maximum width of the "W" is a total of eighteen pixels wide and the maximum width of the "T" is a total of five pixels wide. The overall height of the at least one matrix of each of the letters "W" and "T" is not important but, as illustrated, a total of twelve rows are utilized. The first pixel group in the letter "W" is fetched under control of the system CPU 12 from its associated random access memory storing the character font from which the characters are selected and contains pixels 1–8. No background pixels are discarded with the counter 22 being set to eight with all eight bits being serially outputted from the input shift register 14 to the output shift register 24. The shift counter and 8 bit detect logic 34 counts the eight pixels which are shifted into the output shift register 24 and enables their output in parallel format to the display controller 36. The second pixel group is fetched which contains pixels 9–16. Again, the counter 22 is loaded with eight and all of the pixels 9–16 are shifted from the input shift register 14 to the output shift register 24 because no surplus background pixels are to be discarded for purposes of proportionate spacing. The counters 22 and 34 function as described above to process all of the pixels of the second pixel group without discarding of any background pixels. The third pixel group of the letter "W", which contains pixels 17–24, presents a different situation in that a proportionate spacing of two background pixels is desired which are those pixels at positions 19 and 20 with the additional pixels 21–24 being surplus pixels to be discarded. The overall function of the input shift register 14 and output shift register 24 is to discard the pixels 21–24 and to load the next pixel group which is the single pixel group contained in row 1 of the letter "T" as illustrated in FIG. 2. When the third pixel group of the letter "W" is fetched, the CPU 12 loads the number of bits counter with the number four as a consequence of the stored number of pixels being four to produce proportionate spacing between the letter "W" and "T" requiring only a total of four pixels. After the number of bits counter 22 reaches zero as a consequence of having been loaded with the number four under the control of the system CPU 12, further shifting of the input shift register 14 is inhibited. Thereafter, the single pixel group of the "T" of row 1 in FIG. 2 is fetched and loaded into the input shift register 14 with the number of bits counter being loaded with the number 7 which is required to fully read out all of the visible pixels in the first row of the letter "T" of FIG. 2 including the necessary two background pixels to produce the desired proportionate spacing of two pixels between a next character which is not discussed in this example. Because of the fact that the input shift register 14 has shifted out during the previous load cycle pixels 17–20, the output shift register 24 already contains those four pixels and the shift counter and 8 bit detect logic 34 has already counted the receiving of four pixels. Thereafter, when the input shift register 14 during outputting of the first seven pixels under the control of the number of bits counter 22 counts down a total of four outputted pixels, which represents the outputting of pixels 1–4 of the first row of FIG. 2, the shift counter and 8 bit detect logic 34 has reached a count of eight which enables the output shift register 24 to output the processed pixel group stored into the display controller 36. Thereafter, the remaining visible pixel 5 and two background pixels 6 and 7 are shifted out from the input shift register 14 under the control of counter 22 into the output shift register 24 to complete the processing of the pixel group in row 1 of the letter "T" of FIG. 2.

When the last pixel group is loaded from the last character to be displayed in any line of characters to be proportionately spaced, such as the letter "T" in FIG. 3, the remaining contents of the output shift register 24 are outputted to the display controller 36 by loading a spacing code with the number of bits to complete a byte in the output shift register 24.

The process continues with the input shift register 14 being successively loaded with a sequence of pixel groups from each of the characters "W" and "T" to be proportionately spaced from a left to right manner as given in the above example through all of the rows 1–12. The outputting of processed pixel groups by the output shift register 24 is asynchronous to the inputting of the pixel groups from each of the characters "W" and "T" to be proportionately spaced. Information stored in the random access memory of the system CPU 12 indicates the number of bits to be loaded into the number of bits counter 22 for each pixel group for each line of each of the plurality of characters in the line of alphanumeric characters to be displayed. Furthermore, the output shift register 24 functions under the control of the shift counter and 8 bit detect logic 34 to output processed pixel groups of eight pixels which are applied directly to the display controller 36 to take advantage of the byte oriented architecture of the display controller and display panel 40 which is designed to process in parallel the pixel groups outputted by the output shift register 24.

With the invention, the processing of the pixel matrices of a plurality of characters to provide proportionate spacing to produce an aesthetically pleasing character image having the pixel images read out from the matrices of the character font memory in pixel groups which have a number of pixels identical to the number of pixels stored in a single address location of the character font in the random access memory of the CPU 12 followed by serial processing of individual pixels to discard unnecessary surplus background pixels from each of the at least one pixel matrix of each of the characters to be proportionally spaced provides a high speed system and method for obtaining proportionate spacing at low cost without an unacceptably high processing overhead on the CPU. A high processing overhead on the CPU 12 is unacceptable for applications requiring proportionate spacing in association with advertising or display of messages at fuel dispensers which are marketed by the Assignee because of the extremely cost competitive marketplace which does not permit the use of higher speed expensive industrial grade microprocessors. With lower speed lower cost industrial grade microprocessors used by the Assignee in its fuel dispensers, it is not possible to use software algorithms to accomplish the aforementioned proportionate spacing while controlling other operations required for the display of information at a fuel dispenser.

Each processed pixel group of the characters to be proportionately spaced includes visible pixels from at least one character of the plurality of characters to be proportionately spaced and from zero to a total number of background pixels not greater in number than the background pixels required to proportionately space the character from an adjacent character. For example, it should be noted with respect to FIG. 3 that the pixel group containing pixels 17–24 contains visible pixels 17 and 18 from the letter "W" followed by background pixels 19 and 20 to provide proportionate spacing followed by background pixels 21–24 of the letter "W" which are surplus and which must be discarded to produce proportionate spacing.

However, if the letter "W" had a greater number of pixels between its outside edge pixels, such as edge pixels at pixel positions 1 and 23, it would be necessary to use the spacing code as described above to add one additional background pixel to the pixels obtained from the third matrix to provide two background pixels for proportionate spacing between the letter "W" and the following letter "T". In this case, the pixel data for the spacing code would be placed in the input shift register 14 with the counter 22 being loaded with one. Thereafter, the single background pixel would be shifted from the input shift register 14 to the output register 24 and subsequently the single background pixel would be shifted out when the shift counter and 8 bit detect logic 34 counted to eight.

With respect to FIGS. 1 and 2, the overall process of reading out proportionally spaced letters "W" and "T", sequences from left to right in a sequence of eight bit pixel groups. The process proceeds from the top to bottom such that the pixel groups of the first row are sequentially read out from left to right followed sequentially by the pixel groups of rows 2–12 with each row of pixel groups being read out from left to right.

While the invention has been described in terms of a preferred embodiment in which the parallel processing of pixel groups is byte oriented, it should be understood that the invention is not limited thereto. The invention may be practiced with character fonts which are addressed in address space having groups of pixels other than bytes, such as submultiples of bytes or nibbles or multiple bytes, such as sixteen or thirty-two pixels. Moreover, while the invention has been disclosed in terms of a circuit schematic for implementing the block diagram of FIG. 4 and software modules which may be used in association with the circuit schematic for implementing the block diagram of FIG. 4, it should be understood that the invention is not limited thereto. Furthermore, it should be understood that the invention is not limited to liquid crystal displays and has application to raster-type video displays.

While the invention has been described in terms of its preferred embodiments, it should be understood that numerous modifications may be made thereto without departing from the spirit of the invention as defined in the appended claims. It is intended that all such modifications fall within the scope of the appended claims.

08/512410

© Copyright Gilbarco Inc. 1995

```
#include <stdio.h>
#include <dos.h>
#include <string.h>
#include <stdlib.h>
#include <malloc.h>
#include <graph.h>
#include <io.h>

/* #include "bitio.h" */
/* #include "errhand.h" */
#include "font.h"

void main(int argc, unsigned char * argv[])
{ unsigned char   read_file[15];
  unsigned char   write_file1[15];
  unsigned char   write_file2[15];
  unsigned char   write_file3[15];

  char XX = 0;

  unsigned char   char_code[4];
  unsigned char   la_byte;
  unsigned char   *pixel_byte_ptr;

  int byte_count, error1 = 0, code = 0;
  int i, j, k;
  int next_cell_start = 0, prev_cell_start = 0;
  int start_row, last_row, temp;
  int bytes_per_line;
  int char_num=0;
  unsigned int total_bytes = 0;
  int font_row = 0;
  long expand_bytes;
  long temp_total;
  unsigned int space_width, inter_char, start_char, stop_char, font_number;
  int total_font_lines = 0;
  unsigned int compress_bytes = 0;

  FILE *in_file;  /* file handles */
  FILE *out_file1;
  FILE *out_file2;
/*   BIT_FILE *out_file3; */

  if( argc < 2)
  { info();
    return;
  }

  expand_bytes = 0;

  /* clear the convert buffer to background color */
  for( i = 0; i < MAX_ROW; i++ )
   for( j = 0; j < MAX_COLUMN; j++ )
    convert_buffer[i][j] = 0;

  strcpy(read_file,   argv[1]);
  strcat(read_file,   ".sfp");
  strcpy(write_file1, argv[1]);
  strcpy(write_file2, "font");
  strcpy(write_file3, "font");
  strcat(write_file1, ".bin");
  strcat(write_file2, ".tmp");
  strcat(write_file3, ".cmp");

  /* capture font number and spacing arguments */
  font_number = atoi( argv[2] );
  space_width = atoi( argv[3] );
  inter_char  = atoi( argv[4] );
  start_char  = atoi( argv[5] );
  stop_char   = atoi( argv[6] );

  /* open files and process */
  if( (    out_file1 = fopen(write_file1,"wb") ) == NULL )
    printf(" error opening %s\n", write_file1 );

/*  if( ( out_file3 = OpenOutputBitFile(write_file3) ) == NULL )
    { printf("file open error on output file%s\n",write_file3);
      return;
    }
 */
```

```
if( ( out_file2 = fopen(write_file2,"wb") ) != NULL )
{ if( ( in_file  = fopen(read_file,"rb") ) != NULL )
  { fseek(in_file,0L,0);
    if(fread((unsigned char*)&font_descriptor, 1, sizeof(FONTDESC),in_file) == sizeof(FONTDESC))
    {

      printf(" baseline from top of cell is %d\n",font_descriptor.base_frm_topb );
      printf(" width of cell is %d\n",font_descriptor.cell_widthb );
      printf(" height of cell is %d\n\n",font_descriptor.cell_heightb );

      do
      { /* read in the font character data */
        find_start( in_file );
        get_char_code( in_file, char_code ),
        code = atoi( char_code ),
        if( code >= start_char )
        { get_byte_count( in_file, &byte_count );
          fread((unsigned char*)&char_descriptor, 1, byte_count, in_file);

          printf("character code is %d\n",code);
          printf("character widthm is %d\n",char_descriptor.char_width_msb);
          printf("character widthl is %d\n",char_descriptor.char_width_lsb);
          printf("character heightm is %d\n",char_descriptor.char_height_msb);
          printf("character heightl is %d\n",char_descriptor.char_height_lsb);

          /* initialize conversion variables */
          bytes_per_line = char_descriptor.char_width_lsb/8;
          temp = char_descriptor.char_width_lsb%8;
          if(temp)
            bytes_per_line++;
          pixel_byte_ptr = &char_descriptor.delta_x_lsb + 1;
          start_row = font_descriptor.base_frm_topb - char_descriptor.top_offset_lsb;
          last_row = start_row + char_descriptor.char_height_lsb;

          printf("character start row is %d\n",start_row);
          printf("character end row is %d\n\n",last_row);

          /* expand the font character to OCS standard */
          for( i = start_row; i < last_row; i++ )
          { for( j = 0; j < bytes_per_line; j++ )
            {
                                convert_buffer[i][next_cell_start + j] = *pixel_byte_ptr;

                                if (code == 82 || code == 81)
                                {
                                        printf("pixel_byte = %x i = %x next_cell_start + j = %x\n", *pixel_byte_ptr, i,
                                }

              pixel_byte_ptr++;
            } /* for each byte in the row */
          } /* for each row of the character */

          /* save characteristics in font index array */
          /*printf("old next_cell_start is %d\n",next_cell_start),*/
          prev_cell_start = next_cell_start;
          next_cell_start = next_cell_start + j,
          font_index[char_num][0] = atoi(char_code);
          font_index[char_num][1] = prev_cell_start * 8,
          font_index[char_num][2] = FB_ROW_STRT + ( font_row * font_descriptor.cell_heightb),
          font_index[char_num][3] = char_descriptor.char_width_lsb - 1;
          font_index[char_num][4] = font_descriptor.cell_heightb - 4;

          printf("character hex code = %x\n",font_index[char_num][0]);
          printf("previous cell start = %d\n",font_index[char_num][1]);
          printf("frame buffer start row = %d\n",font_index[char_num][2]),
          printf("character width = %d\n",font_index[char_num][3]);
          printf("character cell height = %d\n\n\n",font_index[char_num][4]);


          /* complete conversion of one font character */

          printf("character code is %d\n",code);
          printf("new next_cell_start is %d\n",next_cell_start);
          printf("prev_cell_start is %d\n\n",prev_cell_start);

          /* check for conversion array full */
          if( next_cell_start > 92 || code >= stop_char )
          { next_cell_start = 0;
            font_row++;
```

```
        printf("*************** gcs array full ***************\n");

        for( i = 0; i < font_descriptor.cell_heightb; i++ )
        {
          for( j = 0; j < (MAX_COLUMN / 2); j++ )
          {
                                printf(" %x", convert_buffer[i][j]);
          }
          printf("\n");
      }
/*                        if (xx == 1)
                          {
                                  fputc( 'A', out_file2 );
                                  fputc( 'A', out_file2 );
                                  fputc( 'A', out_file2 );
                                  fputc( 'A', out_file2 );
                                  fputc( 'A', out_file2 );
                                  fputc( 'A', out_file2 );
                                  fputc( 'A', out_file2 );
                                  fputc( 'A', out_file2 );
                          }
                          ++xx;
*/

        /* write bitmap array to ouput file */
        for( i = 0; i < font_descriptor.cell_heightb; i++ )
        {
          for( j = 0; j < MAX_COLUMN; j++ )
          {

            /* expand the font byte to GCS standard */

            for( k = 0; k < 4; k++ )
            {
                  temp = convert_buffer[i][j] & mask[k];
              temp = temp >> shifts[k];
              gcs_pixel[k]   = FONT_CODE0;
              if( temp == 1 )
                gcs_pixel[k] = FONT_CODE1;
              else if( temp == 2 )
                gcs_pixel[k] = FONT_CODE2;
              else if( temp == 3 )
                gcs_pixel[k] = FONT_CODE3;
            }

            fputc( gcs_pixel[1], out_file2 );
            fputc( gcs_pixel[0], out_file2 );
            fputc( gcs_pixel[3], out_file2 );
            fputc( gcs_pixel[2], out_file2 );

                          printf("byte = %x ", j);
                          printf(" [1] = %x, [0] = %x, [3] = %x, [2] = %x\n", gcs_pixel[1], gcs_pixel[0], gcs_p

            convert_buffer[i][j] = 0;
            total_bytes++;
          } /* for each line byte */
        } /* for each line */

        total_font_lines += font_descriptor.cell_heightb;

        /*  for( i = 0; i < MAX_ROW; i++ )
              for( j = 0; j < MAX_COLUMN; j++ )
                convert_buffer[i][j] = 0; */

      } /* if cell max is reached */
      char_num++;
    } /* if code greater than 10 */
  } while( code < stop_char || next_cell_start >= CELL_MAX);

  printf(" total font lines = %d\n",total_font_lines );

  fclose( in_file );
  fclose( out_file2 );
  out_file2 = fopen(write_file2,"rb");

  /*printf("compressed bytes = %d\n",compress_bytes);*/

  fclose(out_file2);
/*    CloseOutputBitFile( out_file2, &compress_bytes );  */
```

08/512410

```
                /* write validation code */
        i = FONT_VALID;
        fwrite( &i, sizeof(int), 1, out_file1);

        /* write the total byte count of file */
        byte_count = (char_num * 10) + compress_bytes + HEADER_SIZE;
        fwrite( &byte_count, sizeof(int), 1, out_file1);

        /* write the font number */
        fwrite( &font_number, sizeof(int), 1, out_file1);

        byte_count = char_num*5;
        /* write the index byte count */
        fwrite( &byte_count, sizeof(int), 1, out_file1);

        /* write the compressed bitmap byte count */
        fwrite( &compress_bytes, sizeof(int), 1, out_file1);

        /* write the character height */
        fwrite( &font_descriptor.cell_height, sizeof(int), 1, out_file1);

                /* write the space character width */
                fwrite( &space_width, sizeof(int), 1, out_file1);

                  /* write the inter-character space width */
                  fwrite( &inter_char, sizeof(int), 1, out_file1);

                  /* write the start character */
                  fwrite( &start_char, sizeof(int), 1, out_file1);

                  /* write the stop character */
                  fwrite( &stop_char, sizeof(int), 1, out_file1);

                  /* write the total number of font lines */
                  fwrite( &total_font_lines, sizeof(int), 1, out_file1);

        /* write the index data */
        for( i = 0; i < char_num; i++ )
        { for( j = 0; j < 5; j++ )
           fwrite( &font_index[i][j], sizeof(int), 1, out_file1);
        } /* for each character */

        temp_total = (long)((long)total_bytes * (long)4);
        in_file = fopen(write_file2,"rb");
        for( expand_bytes = 0; expand_bytes < temp_total; expand_bytes++ )
        { in_byte = (unsigned char)getc(in_file);
          fputc( in_byte, out_file1 );
        }


        printf(" characters counted = %d\n",char_num);
        printf(" total bytes counted = %d\n",total_bytes);

        fcloseall();

        printf(" total bytes = %d\n",total_bytes);
        printf(" total temporary bytes = %ld\n", temp_total);

        /*
        remove(write_file2);
        remove(write_file1);
        */
        return;
      } /* if header is read */
    } /* if input file opened ok */
    else
     printf("file open error on input file %s\n", read_file);
  } /* if output file opened ok */
  else
   printf("file open error on output file%s\n",write_file1);
  fclose(in_file);
  fclose(out_file1);
  fclose(out_file2);
  return;
} /* fontcont */
```

```
void info( void )
{/* _clearscreen( _GCLEARSCREEN ); */
  printf("\n\n\n                    FSMONO  \n"),
  printf("          Written by Hans Atchley \n");
  printf("        Copyright 1995, GILBARCO INC.        \n\n"),
  printf("This program converts a .afp laserjet compatible font file to\n");
  printf("an uncompressed binary file that is intended to be ROM based \n");
  printf("in the Advantage Monochrome Full Screen Controller ROM \n\n");

  printf("No input file extension is required.  afp is assumed.\n").
  printf("The input file is unchanged, the output file\n");
  printf("has the same filename but with a .bin extension.\n\n");

  printf("Syntax: fsmono filename, font number, space width, \n");
  printf("inter-character spacing width, and decimal value of\n");
  printf("start and stop characters.\n\n");
  printf("Example run: \n");
  printf("fsmono fontfile 0 20 6 24 176\n");

  return;
} /* info */

void find_start( FILE * input_file )
{ /* find the first character */
  int true = 1;
  unsigned char in_byte,
  while( true )
  { in_byte = (unsigned char)getc( input_file ),
    if( in_byte == 0x1B )      /* escape */
    { in_byte = (unsigned char)getc( input_file ),
      if( in_byte == 0x2A )    /* * */
      { in_byte = (unsigned char)getc( input_file ),
        if( in_byte = 0x63 )  /* c */
          true = 0;
      } /* if * is found */
    } /* if escape is found */
  } /* while true */
  return;
} /* find_first */

void get_char_code( FILE *input_file, unsigned char * buffer )
{ unsigned char in_byte;
  in_byte  = (unsigned char)getc( input_file );
  *buffer++ = in_byte;
  while( (in_byte = (unsigned char)getc( input_file)) != 'E' )
   *buffer++ = in_byte;
  /* while input not E */
  *buffer = '\0';
  return;
} /* get_char_code */


void get_byte_count( FILE *input_file, int *byte_count )
{ /* get the data byte count for the character */
  unsigned char in_byte;
  unsigned char convert_buffer[4];
  unsigned char *ptr1,
  ptr1 = convert_buffer;
  while( in_byte  != 'm' )
   in_byte  = (unsigned char)getc( input_file ),
  /* while not m */
  in_byte = (unsigned char)getc( input_file ),
  *ptr1++ = in_byte;
  while( (in_byte = (unsigned char)getc( input_file)) != 'W' )
    *ptr1++ = in_byte;
  /* while input not W */
  *ptr1 = '\0';
  *byte_count = atoi( convert_buffer );
  return;
} /* get_byte_count */


void hex_encode( unsigned char   in_byte
               , unsigned char * out_string
               )
{ char * p;
  unsigned char temp1;
  unsigned char temp2;
  unsigned char temp3[3];
  unsigned char temp4[3];
```

```
  temp1 = (unsigned char)((in_byte & 0xf0) >> 4);
  temp2 = (unsigned char) (in_byte & 0x0f).
  p = itoa(temp1, temp3, 16);
  p = itoa(temp2, temp4, 16);
  p = out_string;
  *p++ = (unsigned char)toupper(temp3[0]);
  *p   = (unsigned char)toupper(temp4[0]);
  return;
}


static unsigned char * add_to_string(   unsigned char *string_ptr
                                     ,  unsigned char *string_data
                                     ,  int           *string_cnt
                                     )
{ if( string_data[0] >= 'A' && string_data[0] <= 'F' )
    *string_ptr++ = PRE_FIX;
  *string_ptr++ = string_data[0];
  *string_ptr++ = string_data[1];
  *string_ptr++ = POST_FIX;
  if(*string_cnt < MAX_DATA_COUNT)
   *string_ptr++ = COMMA;
  return string_ptr;
}
```

```
#define ASM_PARAM "BYTE "
#define PRE_FIX   'D'
#define POST_FIX  'H'
#define COMMA     ','
#define MAX_DATA_COUNT 20
#define MAX_ROW 80
#define MAX_COLUMN    0x60
#define FONT_VALID    0x55
#define FONT_CODE0    0x55        /*  0x99  */
#define FONT_CODE1    0xD5        /*  0xF9  */
#define FONT_CODE2    0x5D        /*  0x9F  */
#define FONT_CODE3    0xDD        /*  0xFF  */
#define HEADER_SIZE   0x12
#define START_CHAR    0x18
#define STOP_CHAR     0x7E
#define CELL_MAX      0x48
#define FB_ROW_STRT   0x0       /* line 482 -> 0x1E2 */

typedef struct
        { unsigned char size_msb,          size_lsb;
          unsigned char f_use_1a,          f_use_1b;
          unsigned char f_use_2a,          f_use_2b;
          unsigned char base_frm_topa,     base_frm_topb;
          unsigned char cell_widtha,       cell_widthb;
          unsigned char cell_heighta,      cell_heightb;
          unsigned char orientation_a,     orientation_b;
          unsigned char symbol_set_a,      symbol_set_b;
          unsigned char pitcha,            pitchb;
          unsigned char font_heighta,      font_heightb;
          unsigned char x_heighta,         x_heightb;
          unsigned char prop_widtha,       prop_widthb;
          unsigned char strokea,           strokeb;
          unsigned char f_use_3a,          f_use_3b;
          unsigned char f_use_4a,          f_use_4b;
          unsigned char u_frm_basea,       u_frm_baseb;
          unsigned char text_heighta,      text_heightb;
          unsigned char text_widtha,       text_widthb;
          unsigned char f_use_5a,          f_use_5b;
          unsigned char f_use_6a,          f_use_6b;
          unsigned char extended_pitcha,   extended_pitchb;
          unsigned char f_use_7a,          f_use_7b;
          unsigned char f_use_8a,          f_use_8b;
          unsigned char f_use_9a,          f_use_9b;
          unsigned char name[16];
        } FONTDESC;

typedef struct
        { unsigned char format_msb,        format_lsb;
          unsigned char size_msb,          size_lsb;
          unsigned char orientation_msb,   orientation_lsb;
          unsigned char left_offset_msb,   left_offset_lsb;
          unsigned char top_offset_msb,    top_offset_lsb;
          unsigned char char_width_msb,    char_width_lsb;
          unsigned char char_height_msb,   char_height_lsb;
          unsigned char delta_x_msb,       delta_x_lsb;
          unsigned char char_data[256];
        } CHARDESC;

unsigned char convert_buffer[MAX_ROW][96];
int font_index[128][5];
unsigned char mask[] = { 0xC0, 0x30, 0x0C, 0x03 };
int shifts[] = { 6, 4, 2, 0 };
unsigned char gos_pixel[4];

FONTDESC font_descriptor; /* font descriptor table */
CHARDESC char_descriptor; /* character descriptor table */

void info( void );

void find_start( FILE * input_file );

void get_char_code( FILE *input_file, unsigned char * buffer );

void get_byte_count( FILE *input_file, int *byte_count );

void hex_encode( unsigned char   in_byte
               , unsigned char * out_string
               );

static unsigned char * add_to_string(   unsigned char *string_ptr
```

09/513410

```
                                    ,   unsigned char *string_data
                                    ,   int           *string_cnt
                                    };

void InitTree( int r );
void ContractNode( int old_node, int new_node );
void ReplaceNode( int old_node, int new_node );
int FindNextNode( int node );
void DeleteString( int p );
int AddString( int new_node, int *match_position );

void main(int argc, unsigned char * argv[]);
```

```
/*****************************************************************
* Function:     BuildString                                       *
*                                                                 *
* Usage:        BuildString (display                              *
*                            ,dest_x                              *
*                            ,dest_y                              *
*                            ,owner                               *
*                            ,root                                *
*                            )                                    *
*                                                                 *
* Purpose:              This function places a series of bitmapped font *
*                            images on the visual display.  This module uses *
*                            external hardware to create proportional spaced *
*                            characters.                          *
*                                                                 *
*                            Note that this version of BuildString() takes advantage *
*                            of the optimized version of Decompress, which reorganises *
*                            the font so that characters may be read out faster when *
*                            strings are written to the display(s).  Inter-character *
*                            spacing is built into the font data.  *
*                                                                 *
*                            The obvious focus of this file is on speed, although we *
*                            have tried to maintain a balance between efficiency and *
*                            safety (range checking, etc )        *
*                                                                 *
* display:              the display address.                      *
*                                                                 *
* dest_x:               the x coordinate where the string is to be displayed. *
*                                                                 *
* dest_y:               the y coordinate where the string is to be displayed. *
*                                                                 *
*                            Note: x and y coordinates are measured in pixels relative *
*                            0,0 at the top left corner of the display. *
*                                                                 *
* owner:                Pointer to field text object.             *
*                                                                 *
* root                  Pointer to root data structure            *
*                                                                 *
* Returns:      Error code                                        *
*                                                                 *
* Author:               Bill Royal                                *
*                                                                 *
*****************************************************************/
#include "gcs_prot.h"

#define WRAPAROUND_TEXT         0
#define TRUE                    1
#define FALSE                   0


char BuildString(       char                    display,
                        int                     dest_x,
                        int                     dest_y,
                        field_object            *owner,
                        display_root            *root )
{
        int                             split_char;                     /* this is used only for        */
                                                                        /* wraparound text.
        unsigned int    pixel_count,                    /* also only for wraparound */
        unsigned char   found = FALSE;                  /* flags when a wraparound      */
                                                                        /* condition is encountered */

        /* Bank location storage for handling MMU routines. */
        char                    image_bank,
                                        work_bank,
                                        save_bank, save_bank_2,

        /* Font manipulation variables. */                      /* font being used                      */
        char                    font_number;                            /* global font struct ptr       */
        font_bitmap             *font_map,                              /* lookahead
                                        *next_fm;                       /* ptr to font index            */
        unsigned int    *index_ptr,                                                     /* ptr to character index

        static unsigned char **char_index_ptr,

        static unsigned int
                                        min_char,
                                        inter_char,
                                        char_height;                    /* height of font in pixels     */
```

```
static char             underscore;                         /* copy of flag                        */

static unsigned char
                                inter_char_image;           /* 0x00 or 0xff, dep. on        */
                                                                        /* value of underscore

static char             row_bytes;                          /* # of bytes in char. row      */
static char             max_rows;                           /* rows of data in bank         */
static unsigned char
                                line_in_bank;
static unsigned int     row_offset;

static char             line;                               /* loop var: current line       */
static char             code;                               /* loop var: current char       */

static unsigned int                                         /* display memory loc. for  */
                                cursor_address;             /* the string pixel coords. */
static unsigned char
                                start_offset;               /* 1st strg. byte offset    */


/* The count and data bytes retrieved from the font data. */
static unsigned char
                                *data_ptr,                          /* points to next char          */
                                bit_count,                          /* pixel count byte
                                image;                              /* image data byte

/* Miscellaneous local storage. */
char                    error;                              /* return code                          */
char                    string[ STRING_SIZE ];  /* local copy of string         */
char                    *string_ptr,                        /* initial ptr to text str. */
static unsigned int     i,                                  /* workspace                            */
static unsigned char
                                LCD_params[ 2 ];            /* S1335 command parameters     */

static unsigned char
                                disp_ctrl,                          /* control port bitmap var.     */
static unsigned char
                                blanks;                             /* 1's or 0's dep. on invert*/


if (display == BOTH_SIDES)
{
        if ( error = BuildString( SIDE_A, dest_x, dest_y, owner, root ) )
                return error;

        error = BuildString( SIDE_B, dest_x, dest_y, owner, root );
        return error;
}

/* Capture font number and owner bank. */
font_number = owner -> font_number;
underscore = owner -> underscore;
string_ptr = owner -> text;

/* Make a local copy of the string, then determine pixel length of the string. */
for( i = 0; i < STRING_SIZE; i++ )
        string[i] = *string_ptr++;


/* Find system font for this string and set the appropriate RAM bank. */
save_bank = set_bank( ROOT_BANK );
if ( ( font_map = root -> first_font ) == NULL )
{
        set_bank( save_bank );
        return UNKNOWN_FONT;
}

while ( ( ( next_fm = font_map -> next_font ) != NULL ) &&
                ( font_number != font_map -> number ) )
{
        work_bank = font_map -> next_bank;
        font_map = next_fm;
        set_bank( work_bank );
}

if ( font_number != font_map -> number )
{
        set_bank( save_bank );
```

```
        return UNKNOWN_FONT;
}

/* Get font header information. */
image_bank = font_map -> image_bank;
index_ptr = (unsigned int *) 0xF000;
char_index_ptr = ( unsigned char ** ) 0xF000;

min_char = font_map -> first_character;
inter_char = font_map -> inter_char_space;
char_height = font_map -> char_height;

row_bytes = font_map -> char_row_bytes;
max_rows = font_map -> max_rows;

pixel_count = dest_x;
if ( !font_number )
        save_bank_2 = set_bus_bank( FONT_ROM, image_bank );
else
        save_bank_2 = set_bank( image_bank );

// tickle the watchdog
WatchDogTimer();

for( i = 0; i < STRING_SIZE; i++ )
{
        code = string[i] - min_char;
        if ( ( code >= 0 ) && ( code < NUM_CHARS ) )
        {
                pixel_count += *( index_ptr + ( 5 * code ) + 3 );
                pixel_count += inter_char;
                if ( (pixel_count >> 3) >= SCREEN_WIDTH )
                {
                        found = TRUE;
                        split_char = i-1;
                } /* if pixel_count... */
        } /* if code >= 0... */
} /* for i=0... */

if ( !font_number )
        set_bus_bank( FONT_ROM, save_bank_2 );
else
        set_bank( save_bank_2 );

/* This section was added primarily to better handle single-line emulation mode.        */
/* It ensures that a line of text, if too long for the display, will wrap around        */
/* without overwriting itself, even though it will probably chop a word in half.        */
if ( WRAPAROUND_TEXT && found )
{
        char    start[ 20 ],
                        finish[ 18 ],

        for ( i = 0; i <= split_char; i++ )
                start[i] = string[i];
        start[ i ] = '\0';

        for ( i = split_char+1; string[i] != '\0'; i++ )
                finish[ i-split_char-1 ] = string[i];
        finish[ i-split_char-1 ] = '\0';

        // Now just find a way to call BuildString() recursively with these two strings.
}

if ( dest_y + char_height >= DISPLAY_HEIGHT )
{
        set_bank( save_bank );
        return INVALID_YPOS;
}

// Initialize and set the working bank
work_bank = image_bank + 1;
if ( !font_number )
        save_bank_2 = set_bus_bank( FONT_ROM, work_bank );
else
        save_bank_2 = set_bank( work_bank );

cursor_address = dest_y * SCREEN_WIDTH + ( dest_x >> 3 );
start_offset = dest_x % 8;
line_in_bank=0;
```

```
        row_offset = 0;

        /* Set disp_ctrl based on display input. */
        if ( display == SIDE_A )
                disp_ctrl = ODELowA;
        else
                disp_ctrl = ODELowB;

        /* for every row of displayed string */
        for ( line = 0; line < char_height;
                line++, cursor_address += SCREEN_WIDTH )
        {

                // tickle the watchdog
                WatchDogTimer();

                /* Position the cursor, and then start the write. */
                LCD_params[ 0 ] = cursor_address & 256;
                LCD_params[ 1 ] = cursor_address >> 8;
                WrDisplayController( display, CURW, 2, LCD_params );
                WrSetDisplayMode( MWRITE, display );

                /* Offset the starting position within the first byte  */
                /* For speed reasons, avoid another function call. */
                gcs_outp( DISPLAY_CONTROL, disp_ctrl );

                if ( display == SIDE_A )

// Figure out the value to which 'blanks' should be set
// Treat all four possible combinations.
#if A_IMAGE == POSITIVE
                        blanks = POS_BLANKS;
#else
                        blanks = NEG_BLANKS;
#endif

                else            // display == SIDE_B

#if B_IMAGE == POSITIVE
                        blanks = POS_BLANKS;
#else
                        blanks = NEG_BLANKS;
#endif

                gcs_outp( DISPLAY_DATA, blanks ),
                gcs_outp( NUMBER_OF_BITS, start_offset );

                /* for every character on the line */
                for ( code = string[ i = 0 ]; code; code = string[ ++i ] )
                {
                        /* get relative value for character. */
                        code -= min_char.

                        /* make sure character is displayable */
                        if ( ( code >= 0 ) && ( code < NUM_CHARS ) )
                        {
                                inter_char_image = NEG_BLANKS.                          /* what to write between chars.

                                data_ptr = ( unsigned char * ) ( *( char_index_ptr + code ) + row_offset ).

                                bit_count = *( data_ptr++ );
                                while ( bit_count )
                                {
                                        /* Get a byte of image data.  Data is precounted, pre-inverted, */
                                        /* and aligned to account for inter-character spacing.                  */
                                        image = *( data_ptr++ );
                                        if ( underscore )
                                                if ( line == char_height - 0x03 )
                                                        inter_char_image = image = 0x80;

                                        /* For speed reasons, avoid another function call. */
                                        gcs_outp( DISPLAY_CONTROL, disp_ctrl );

#if B_IMAGE == POSITIVE
                                        if ( display == SIDE_B )
                                                image = ~image;
#endif
#if A_IMAGE == POSITIVE
                                        if ( display == SIDE_A )
                                                image = ~image;
```

08/513410

```
#endif
                                        gcs_outp( DISPLAY_DATA, image );
                                        gcs_outp( NUMBER_OF_BITS, bit_count );

                                        bit_count = *( data_ptr++ );
                                } /* while bit_count... */

                                /* For speed reasons, avoid yet another function call. */
                                gcs_outp( DISPLAY_CONTROL, disp_ctrl );

#if B_IMAGE == POSITIVE
                                        if ( display == SIDE_B )
                                                inter_char_image = -inter_char_image;

#endif
#if A_IMAGE == POSITIVE
                                        if ( display == SIDE_A )
                                                inter_char_image = -inter_char_image;

#endif
                                gcs_outp( DISPLAY_DATA, inter_char_image );
                                gcs_outp( NUMBER_OF_BITS, (unsigned char) inter_char );
                        } /* if code >= 0... */
                } /* for code = string[0]... */


                /* Step up to the next bank when you get to the far right side. */
                if ( ++line_in_bank == max_rows )
                {
                        line_in_bank = 0;
                        set_bus_bank( FONT_ROM, ++work_bank );
                        row_offset = 0;
                } /* ++line_in_bank... */
                else
                        row_offset += row_bytes;

                /* output a dummy byte to flush the shift register at the end of the line. */
                /* For speed reasons, avoid even yet another function call. */
                gcs_outp( DISPLAY_CONTROL, disp_ctrl );

                gcs_outp( DISPLAY_DATA, blanks );
                gcs_outp( NUMBER_OF_BITS, 8 );

                /* deselect the LCD ports.  Note:  do this BEFORE a NEW_LINE (DISPLAY_RESET). */
                gcs_outp(DISPLAY_CONTROL,CDHLOWA | CHIP_DESELECTS);      /* Port 8000, Deselect */

                /* reset the shift register logic for a new line of data */
                gcs_outp( DISPLAY_RESET, 0 );

        } /* for line = 0... */

        set_bank( save_bank );
        return NO_ERROR;
}
```

We claim:

1. A process for proportionately spacing a plurality of characters comprising:

(a) storing a character font in a memory defining a group of characters which individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of a total number of pixels in the at least one matrix of each selectable character are stored in the memory as a second binary value;

(b) reading from the memory a selected row of pixels from the at least one matrix of each of the plurality of characters in a sequence of pixel groups with each pixel group containing a fixed number of pixels and being read from the memory in parallel;

(c) producing processed pixel groups containing the proportionately spaced plurality of characters by processing the sequence of pixel groups of the plurality of characters from the selected row by serially processing the individual pixels within each pixel group which has been read to selectively add or discard pixels from the at least one matrix of each of the selected characters;

(d) sequentially outputting in parallel the processed pixel groups of the selected row with each processed pixel group containing the fixed number of pixels to produce proportionate spacing in the selected row between the pixels of adjacent characters within the selected row; and (e) repeating steps (b)–(d) to select and process each remaining row of the matrices of the plurality of characters.

2. A process in accordance with claim 1 wherein:

the processed pixel groups of the selected row are outputted to a display controller and displayed by a display device under control of the display controller.

3. A process in accordance with claim 2 wherein:

at least one of the processed pixel groups contains pixels from two characters of the plurality of characters separated by the number of background pixels required for the proportionate spacing between the characters.

4. A process in accordance with claim 3 wherein:

the processed pixel groups are produced by discarding surplus background pixels from the selected row of the matrices of the plurality of characters.

5. A process in accordance with claim 3 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

6. A process in accordance with claim 3 wherein:

one matrix of each of the characters has visible pixels extending from a vertical outer edge of the matrix in the direction of reading.

7. A process in accordance with claim 6 wherein:

the vertical outer edge is the left-hand edge of the one matrix; and the proportionate spacing between each pair of the plurality of characters is a constant number of pixels.

8. A process in accordance with claim 2 wherein:

the processed pixel groups are produced by discarding surplus background pixels from the selected row of the matrices of the plurality of characters.

9. A process in accordance with claim 2 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

10. A process in accordance with claim 2 wherein:

one matrix of each of the characters has visible pixels extending from a vertical outer edge of the matrix in the direction of reading.

11. A process in accordance with claim 10 wherein:

the vertical outer edge is the left-hand edge of the one matrix; and the proportionate spacing between each pair of the plurality of characters is a constant number of pixels.

12. A process in accordance with claim 10 wherein:

the display device is a liquid crystal display.

13. A process in accordance with claim 2 wherein:

the display device is a liquid crystal display.

14. A process in accordance with claim 1 wherein:

at least one of the processed pixel groups contains pixels from two characters of the plurality of characters separated by the number of background pixels required for the proportionate spacing between the characters.

15. A process in accordance with claim 14 wherein:

the processed pixel groups are produced by discarding surplus background pixels from the selected row of the matrices of the plurality of characters.

16. A process in accordance with claim 14 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

17. A process in accordance with claim 14 wherein:

one matrix of each of the characters has visible pixels extending from a vertical outer edge of the matrix in the direction of reading.

18. A process in accordance with claim 17 wherein:

the vertical outer edge is the left-hand edge of the one matrix; and the proportionate spacing between each pair of the plurality of characters is a constant number of pixels.

19. A process in accordance with claim 14 wherein:

the display device is a liquid crystal display.

20. A process in accordance with claim 1 wherein:

the processed pixel groups are produced by discarding surplus background pixels from the selected row of the matrices of the plurality of characters.

21. A process in accordance with claim 1 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

22. A process in accordance with claim 1 wherein:

one matrix of each of the characters has visible pixels extending from a vertical outer edge of the matrix in the direction of reading.

23. A process in accordance with claim 22 wherein:

the vertical outer edge is the left-hand edge of the one matrix; and the proportionate spacing between each pair of the plurality of characters is a constant number of pixels.

24. A system for proportionately spacing a plurality of characters comprising:

(a) a memory for storing a character font defining a group of characters which individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of a total number of pixels in the at least one matrix of each selectable character are stored in the memory as a second binary value;

(b) means for reading from the memory each of the rows of pixels from the at least one matrix of each of the plurality of characters in a sequence of pixel groups with each pixel group containing a fixed number of pixels and being read from the memory in parallel; and (c) means for producing processed pixel groups containing the proportionately spaced plurality of characters by processing individual pixels within the sequence of pixel groups of the plurality of characters of each of the rows of pixels by serially processing the individual pixels within each pixel group which has been read to selectively add or discard pixels from the at least one matrix of each of the selected characters and sequentially outputting in parallel the processed pixel groups with each processed pixel group containing the fixed number of pixels to produce proportionate spacing between the pixels of adjacent characters.

25. A system in accordance with claim 24 wherein:

the processed pixel groups of the selected row are outputted to a display controller and displayed by a display device under control of the display controller.

26. A system in accordance with claim 25 wherein:

the at least one of the processed pixel groups contains pixels from two characters of the plurality of characters separated by a number of background pixels representing the proportionate spacing between the characters.

27. A system in accordance with claim 26 wherein:

the processed pixel groups are produced by discarding surplus background pixels from the selected row of the matrices of the plurality of characters.

28. A system in accordance with claim 26 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

29. A system in accordance with claim 26 wherein:

one matrix of each of the characters has visible pixels extending from a vertical outer edge of the matrix in the direction of reading.

30. A system in accordance with claim 29 wherein:

the vertical outer edge is the left-hand edge of the one matrix; and the proportionate spacing between each pair of the plurality of characters is a constant number of pixels.

31. A system in accordance with claim 26 wherein:

the display device is a liquid crystal display.

32. A system in accordance with claim 25 wherein:

the processed pixel groups are produced by discarding surplus background pixels from the selected row of the matrices of the plurality of characters.

33. A system in accordance with claim 32 wherein:

the display device is a liquid crystal display.

34. A system in accordance with claim 25 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

35. A system in accordance with claim 34 wherein:

the display device is a liquid crystal display.

36. A system in accordance with claim 25 wherein:

one matrix of each of the characters has visible pixels extending from a vertical outer edge of the matrix in the direction of reading.

37. A system in accordance with claim 36 wherein:

the vertical outer edge is the left-hand edge of the one matrix; and the proportionate spacing between each pair of the plurality of characters is a constant number of pixels.

38. A system in accordance with claim 25 wherein:

the display device is a liquid crystal display.

39. A system in accordance with claim 24 wherein:

the at least one of the processed pixel groups contains pixels from two characters of the plurality of characters separated by a number of background pixels representing the proportionate spacing between the characters.

40. A system in accordance with claim 39 wherein:

the processed pixel groups are produced by discarding surplus background pixels from the selected row of the matrices of the plurality of characters.

41. A system in accordance with claim 39 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one pixel group of background pixels and adding a number of pixels from the spacing code between the last matrix of the one character and a first matrix of the adjacent character in a direction of reading of the pixels to produce proportionate spacing between the one and the adjacent one of the plurality of characters.

42. A system in accordance with claim 39 wherein:

one matrix of each of the characters has visible pixels extending from a vertical outer edge of the matrix in the direction of reading.

43. A system in accordance with claim 42 wherein:

the vertical outer edge is the left-hand edge of the one matrix; and the proportionate spacing between each pair of the plurality of characters is a constant number of pixels.

44. A system in accordance with claim 24 wherein:

the processed pixel groups are produced by discarding surplus background pixels from the selected row of the matrices of the plurality of characters.

45. A system in accordance with claim 24 wherein:

a last matrix within the at least one matrix of one of the plurality of characters in a direction of reading of the pixels has a visible pixel at an outer edge of the character which is spaced from an outer edge of the last matrix in the direction of reading of the pixels from the memory by a number of pixels less than a number of background pixels required for proportionate spacing between the one and an adjacent one of the plurality of characters; and proportionate spacing between the one of the plurality of characters and the adjacent character is produced by inserting a spacing code containing at least one matrix of background pixels and adding a number of pixels from the spacing code between the last matrix of the one character and a first matrix of the adjacent character in a direction of reading of the pixels to produce proportionate spacing between the one and the adjacent one of the plurality of characters.

46. A system in accordance with claim 24 wherein:

one matrix of each of the characters has visible pixels extending from a vertical outer edge of the matrix in the direction of reading.

47. A system in accordance with claim 46 wherein:

the vertical outer edge is the left-hand edge of the one matrix; and the proportionate spacing between each pair of the plurality of characters is a constant number of pixels.

48. A system in accordance with claim 24 wherein:

the means for reading comprises a microprocessor; and the means for producing comprises first and second shift registers, a first counter, a second counter, and the microprocessor, and wherein;

the first shift register is coupled to the microprocessor for receiving the pixel groups in parallel, the second shift register is serially coupled to an output of the first shift register for serially receiving individual pixels outputting from the first shift register, the first counter is coupled to the microprocessor and to the first shift register for storing a number received from the microprocessor representing a number of visible pixels and any background pixels required for proportionate spacing between any adjacent characters in the pixel group to be serially shifted out of the first shift register from each pixel group received from the microprocessor, counts the number of pixels which are shifted serially from the first shift register into the second shift register and inhibits further shifting of pixels from the first shift register into the second shift register when a number of pixels have been shifted from the first shift register to the second shift register which equals the number stored in the first counter, the second counter counts a number of pixels which have been received by the second shift register from the first shift register and provides an output when the number of pixels received by the second shift register equals the fixed number of pixels and the second shift register in response to the second counter counts the fixed number of pixels outputting in parallel the fixed number of pixels stored in the second shift register.

49. A system in accordance with claim 48 wherein:

the first register receives another pixel group of pixels from the microprocessor after the number of pixels equal to the number stored in the first counter has been shifted to the second shift register and the first counter receives and stores from the microprocessor another number of pixels of the another pixel group to be shifted from the first shift register to the second shift register.

50. A system in accordance with claim 49 wherein:

the additional number is a number of visible pixels and any background pixels required for proportionate spacing between visible pixels between adjacent characters in the pixel group; and the additional number of pixels from the additional pixel group are serially shifted from the first shift register to the second shift register and thereafter the first counter inhibits the serial shifting of any additional pixels from the another pixel group in the first shift register to the second shift register.

51. A process for proportionately spacing a plurality of characters comprising:

(a) storing a character font in a memory defining a group of characters which individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of a total number of pixels in the at least one matrix of each selectable character are stored in the memory as a second binary value;

(b) reading from the memory a selected row of pixels from the at least one matrix of each of the plurality of characters in a sequence of pixel groups with each pixel group containing a fixed number of pixels;

(c) producing processed pixel groups containing the proportionately spaced plurality of characters by processing individual pixels within the sequence of pixel groups of the plurality of characters from the selected row;

(d) sequentially outputting in parallel the processed pixel groups of the selected row to a display controller and displaying the processed pixel groups with a display device under control of the display controller; and (e) repeating steps (b)–(d) to select and process each remaining row of the matrices of the plurality of characters.

52. A process in accordance with claim 51 wherein:

the reading from the memory is in parallel;

the processing of the sequence of pixel groups is by serially processing the individual pixels within each pixel group which has been read to selectively add or discard pixels from the at least one matrix of each of the selected characters; and the outputting in parallel the processed pixel groups of the selected row is with each processed pixel group containing the fixed number of pixels to produce proportionate spacing in the selected row between the pixels of adjacent characters within the selected row.

53. A system for proportionately spacing a plurality of characters comprising:

(a) a memory for storing a character font defining a group of characters which individually selected, each selectable character containing at least one matrix of pixels with each matrix containing a plurality of rows of pixels with each row having pixels extending in a direction of reading of the pixels from the memory, visible pixels in the at least one matrix of each selectable character defining a visible shape which is stored in the memory as a first binary value and background pixels in the at least one matrix of each selectable character which are a remainder of a total number of pixels in the at least one matrix of each selectable character are stored in the memory as a second binary value;

(b) means for reading from the memory each of the rows of pixels from the at least one matrix of each of the plurality of characters in a sequence of pixel groups with each pixel group containing a fixed number of pixels;

(c) means for producing processed pixel groups containing the proportionately spaced plurality of characters by processing individual pixels within the sequence of pixel groups of the plurality of characters of each of the rows of pixels;

(d) means for sequentially outputting in parallel the processed pixel groups;

(e) a display controller, coupled to the means for sequentially outputting, for receiving the parallel processed pixel groups from the means for sequentially outputting; and (f) a display device, coupled to the display controller, for displaying parallel processed pixel groups received from the display controller under the control of the display controller.

* * * * *